US012535300B2

(12) United States Patent
Speyer et al.

(10) Patent No.: US 12,535,300 B2
(45) Date of Patent: Jan. 27, 2026

(54) COMPACT RIFLE PROTECTION BALLISTIC SHIELD

(71) Applicant: Verco Materials, LLC, Atlanta, GA (US)

(72) Inventors: Robert F. Speyer, Atlanta, GA (US); John A. Shupe, Atlanta, GA (US); Gabriel Todd, Atlanta, GA (US); Christian B. Schneider, Atlanta, GA (US)

(73) Assignee: VERCO MATERIALS, LLC, Atlanta, GA (US)

( * ) Notice: Subject to any disclaimer, the term of this patent is extended or adjusted under 35 U.S.C. 154(b) by 90 days.

(21) Appl. No.: 18/236,644

(22) Filed: Aug. 22, 2023

(65) Prior Publication Data

US 2024/0426581 A1 Dec. 26, 2024

Related U.S. Application Data

(60) Provisional application No. 63/504,517, filed on May 26, 2023, provisional application No. 63/400,248, filed on Aug. 23, 2022.

(51) Int. Cl.
*F41H 5/08* (2006.01)
*F41H 5/04* (2006.01)

(52) U.S. Cl.
CPC ..... *F41H 5/08* (2013.01); *F41H 5/0435* (2013.01)

(58) Field of Classification Search
CPC ..... F41H 5/08; F41H 5/12; F41H 1/00
See application file for complete search history.

(56) References Cited

U.S. PATENT DOCUMENTS 6,370,690 B1 4/2002 Neal
7,389,718 B1 6/2008 Carter et al.
(Continued)

FOREIGN PATENT DOCUMENTS

AU 2017204889 A1 2/2018
JP 7-305999 A 11/1995
KR 10-1961686 B1 3/2019

OTHER PUBLICATIONS

International Search Report and Written Opinion mailed Mar. 5, 2024 in corresponding International Patent Application No. PCT/US2023/030833.

*Primary Examiner* — J. Woodrow Eldred
(74) *Attorney, Agent, or Firm* — OSTROLENK FABER LLP

(57) ABSTRACT

A rollable armor panel, and a rollable ballistic shield that includes the rollable armor panel is described. The rollable armor panel includes an adhesive-coated first ballistic fabric, a plurality of ballistic tiles arranged on and attached to one side of the first ballistic fabric, and a lattice arrangement of adhesive-coated ballistic fabric attached to the ballistic tiles and located opposite to the one side, the lattice having openings over the ballistic tiles, the armor panel being flexible enough to permit rolling of the armor panel into a rolled state. In order to facilitate rolling, the fabric lattice on the rear side of the imbricated array of wrapped ceramic tiles permits lifting of one side of a tile relative to another along the rolling direction. Further, the fabric-encapsulated wrapped imbricated ceramic is attached to a ballistic fabric backer in such a way that layers can slide over each other during rolling and unrolling. Attachment points of the various components of the armor are designed to return those components into alignment when the shield is deployed flat from its rolled state.

24 Claims, 13 Drawing Sheets

(56) References Cited

U.S. PATENT DOCUMENTS

| | | | | |
|---|---|---|---|---|
| 7,980,166 | B1 | 7/2011 | Fuqua et al. | |
| 8,210,088 | B1 | 7/2012 | Keyfauver | |
| 10,591,257 | B1 * | 3/2020 | Barr | B22F 10/28 |
| 10,684,101 | B2 | 6/2020 | Zhang et al. | |
| 11,047,651 | B2 | 6/2021 | Speyer et al. | |
| 11,313,651 | B2 | 4/2022 | Hadtke et al. | |
| 2002/0104429 | A1 | 8/2002 | Euler | |
| 2011/0314998 | A1 | 12/2011 | Engelbart | |
| 2012/0174748 | A1 | 7/2012 | Landi | |
| 2012/0177869 | A1 | 7/2012 | Micarelli | |
| 2012/0192339 | A1 | 8/2012 | Bhatnagar et al. | |
| 2015/0343737 | A1 | 12/2015 | Strauss | |
| 2018/0147082 | A1 * | 5/2018 | Maltais | A61F 5/37 |
| 2018/0156577 | A1 | 6/2018 | Navin et al. | |
| 2020/0393217 | A1 | 12/2020 | Adrain | |
| 2021/0215459 | A1 | 7/2021 | Chen | |
| 2021/0215460 | A1 * | 7/2021 | Fitzpatrick | F41H 5/013 |
| 2021/0254934 | A1 | 8/2021 | Hadtke et al. | |
| 2021/0270574 | A1 * | 9/2021 | Bopp | F41H 5/0471 |
| 2023/0417513 | A1 * | 12/2023 | Boydd | F41H 1/02 |

* cited by examiner

COMPACT RIFLE PROTECTION BALLISTIC SHIELD

CROSS-REFERENCE TO RELATED APPLICATIONS

This application claims priority to U.S. Provisional Application Ser.

No. 63/400,248, entitled Compact Rifle Protection Shield, filed Aug. 23, 2022, and U.S. Provisional Application Ser. No. 63/504,517, entitled Compact Deployable Rifle-Protection Ballistic Shield Design, filed May 26, 2023, the contents of which are incorporated by this reference.

BACKGROUND OF THE INVENTION

The present invention relates to ballistic shields.

Police tactical operators train with and utilize large rigid ballistic shields for protection while advancing on an active shooter. Often these ballistic shields are designed to stop only hand-gun rounds.

Ballistic shields that can stop bullets fired from assault rifles (long guns, e.g., the AR-15 and the AK-47) can be quite heavy. Furthermore, these large and bulky shields require specialized transportation, cannot be accommodated in the cabin of a typical squad car. In some cases, such a shield may be stored in the trunk, which would not be readily accessible, thereby adding to the officer's vulnerability in a threatening situation.

Increasingly, with active shooter situations, there is an expectation for the first-arriving law enforcement officer to engage the shooter immediately, rather than waiting for SWAT operators to arrive, which may put the officer at a grave disadvantage facing an active shooter who is using an assault rifle and is perhaps

CROSS-REFERENCE TO RELATED APPLICATIONS

This application claims priority to U.S. Provisional Application Ser.

No. 63/400,248, entitled Compact Rifle Protection Shield, filed Aug. 23, 2022, and U.S. Provisional Application Ser. No. 63/504,517, entitled Compact Deployable Rifle-Protection Ballistic Shield Design, filed May 26, 2023, the contents of which are incorporated by this reference.

BACKGROUND OF THE INVENTION

The present invention relates to ballistic shields.

Police tactical operators train with and utilize large rigid ballistic shields for protection while advancing on an active shooter. Often these ballistic shields are designed to stop only hand-gun rounds.

Ballistic shields that can stop bullets fired from assault rifles (long guns, e.g., the AR-15 and the AK-47) can be quite heavy. Furthermore, these large and bulky shields require specialized transportation, cannot be accommodated in the cabin of a typical squad car. In some cases, such a shield may be stored in the trunk, which would not be readily accessible, thereby adding to the officer's vulnerability in a threatening situation.

Increasingly, with active shooter situations, there is an expectation for the first-arriving law enforcement officer to engage the shooter immediately, rather than waiting for SWAT operators to arrive, which may put the officer at a grave disadvantage facing an active shooter who is using an assault rifle and is perhaps wearing his/her own body armor. Even if the officer is wearing rifle-threat rated body armor, much of his/her body (e.g., face and lower torso) would be exposed.

SUMMARY OF THE INVENTION

It is an object of the present invention to provide a ballistic shield that may be rolled up to a manageable size so that it may be transported in the cabin of a police cruiser and accessed quickly without exiting the patrol car.

Another object of the present invention is to provide a rollable ballistic shield that, when deployed, can stop bullets fired from assault rifles, including bullets that can only be stropped at reasonable weights by ceramic strike faces (e.g. the M855 bullet).

A rollable armor panel according to the present invention includes a first ballistic fabric; a plurality of ballistic-fabric-wrapped, or unwrapped, ballistic tiles arranged on and (e.g. adhesively) attached to one side of the first ballistic fabric; and a lattice arrangement comprising ballistic fabric (e.g. adhesively) attached to the ballistic tiles and located opposite to the one side, the lattice having openings over the ballistic tiles, wherein the armor panel is flexible enough to permit rolling of the armor panel into a rolled state.

In one embodiment, the lattice is positioned over rear faces of the ballistic tiles.

In another embodiment, the lattice is positioned over strike faces of the ballistic tiles.

A rollable armor panel according to the present invention further includes a second ballistic fabric integrated with another side of the first ballistic fabric opposite the one side of the first ballistic fabric.

In a rollable armor panel according to the present invention the first ballistic fabric is a ballistic aramid fabric, and the second ballistic fabric is a carbon fiber fabric.

A rollable armor panel according to the present invention may be integrated with ballistic fabric backing sheets to make a ballistic panel. A ballistic panel so made may be integrated with a carrier to devise a rollable ballistic shield.

The ballistic fabric backing sheets may be attached to the armor panel only along a portion of a first side thereof and only along a portion of a second side thereof, the first side and the second side being opposite one another.

A fabric strip may be adhesively attached to the armor panel, wherein the ballistic fabric backing sheets are adhesively attached to the fabric strip, the fabric strip holding the armor panel and the ballistic fabric backing sheets together along a limited area to maintain their mutual alignment, while permitting mutual sliding required for rolling and unrolling.

The ballistic fabric backing sheets may be present in sub-packs, wherein a first sub-pack is attached directly along only a portion thereof to a portion of a second sub-pack only, the second sub-pack is attached at another portion thereof directly to only a portion of a third sub-pack, and the third sub-pack has another portion directly attached only to a portion of a fourth sub-pack.

The ballistic fabric backing sheets may be sheets of ultra-high molecular weight polyethylene.

The armor panel may have recessed regions defined along opposite sides thereof, and the carrier may have a belt located on an exterior surface thereof to be accommodated in the recessed regions of the armor panel.

The carrier may further have at least one handle, a plurality of D-rings, and a sling that is receivable in the D-rings.

The carrier may also have a closure pad that carries at least a portion of a releasable fastener that can be fastened to another portion of the fastener to maintain the rollable ballistic shield in a rolled state.

While a shield according to the present invention is preferably used by law enforcement, a shield according to the present invention can also be used by other first responders, security personnel, and others to provide cover to allow for rendering of aid in locations perceived to be unsafe, or to extricate people or items.

A shield according to the present invention allows for, for example, compact storage in drawers or cabinets of school resource officers. Also with the sling, the shield in its rolled form looks similar to a garment bag which may be carried, slung over the shoulder. This is useful in executive protection and at large entertainment and sports venues in which carrying hard shields would otherwise interfere with mobility, and give an inappropriately military complexion to the event.

Other features and advantages of the present invention will become apparent from the following description of the invention.

DETAILED DESCRIPTION OF EMBODIMENTS OF THE INVENTION

The present invention is concerned with a ballistic shield that can stop rifle threats. The ballistic shield can roll up to a compact form so that it may, reside on the passenger seat or floor of the passenger side of a typical squad car, readily accessible to the officer, for example, in the event of a need for immediate engagement of an active shooter.

A ballistic shield according to the present invention may be deployed as a car-door shield, or a hand-held personal shield while advancing from, for example, the patrol car. The present invention when deployed has the elasticity to absorb impacts with immovable surfaces/objects without staggering the holder and exposing the holder to injury. In contrast to the present invention, rigid shields reduce the mobility of the user by restricting the user's ability to move around or through tight spaces i.e. doorways, blind corners, hand or safety rails.

The ballistic shield may be based on a personal armor system disclosed, for example, in U.S. Pat. No. 11,047,651 ('651 patent), which comprises an imbricated pattern of high-performance ceramic tiles (wrapped with ballistic fabric or unwrapped), backed by layers of ballistic fabric such as an aramid or a high molecular weight polyethelene. The ceramic tiles disclosed in U.S. application Ser. No. 18/096,664, filed Jan. 13, 2023, entitled CERAMIC TILE DESIGN IMPROVEMENT FOR CONFORMAL PERSONAL ARMOR, may also be used in a ballistic shield according to the present invention.

Figure 4:
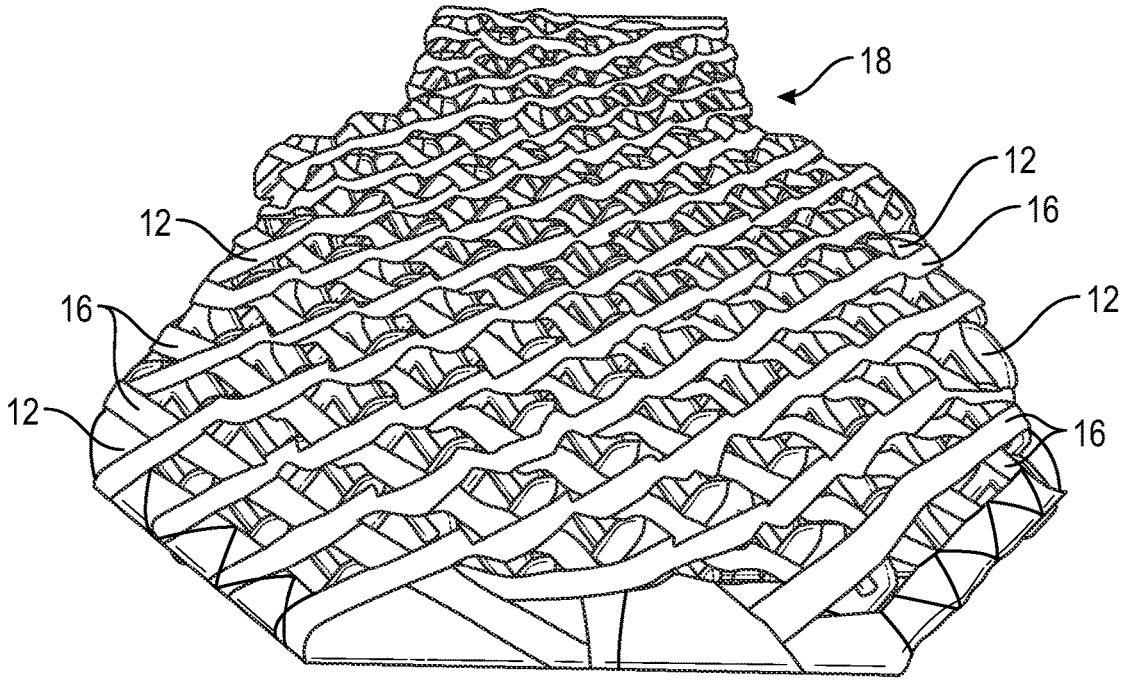
FIG. 4 shows a lattice of ballistic aramid fiber strips on the rear-face side of the imbricated tiles shown in FIG. 2.
Figure 9:
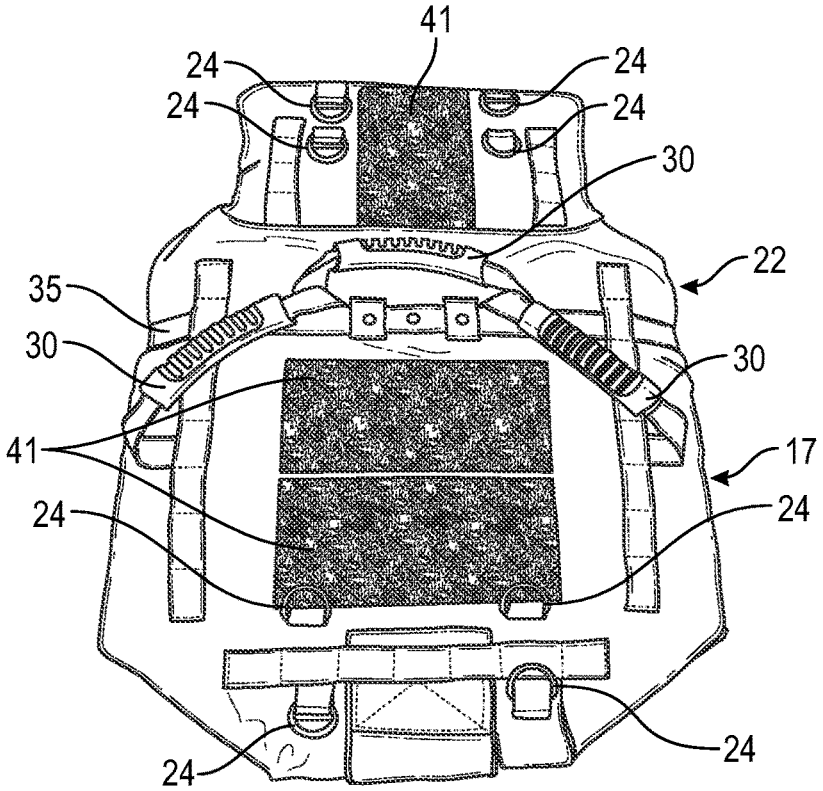
FIG. 9 shows a rear face of the carrier of a ballistic shield according to the present invention.
Figure 10A:
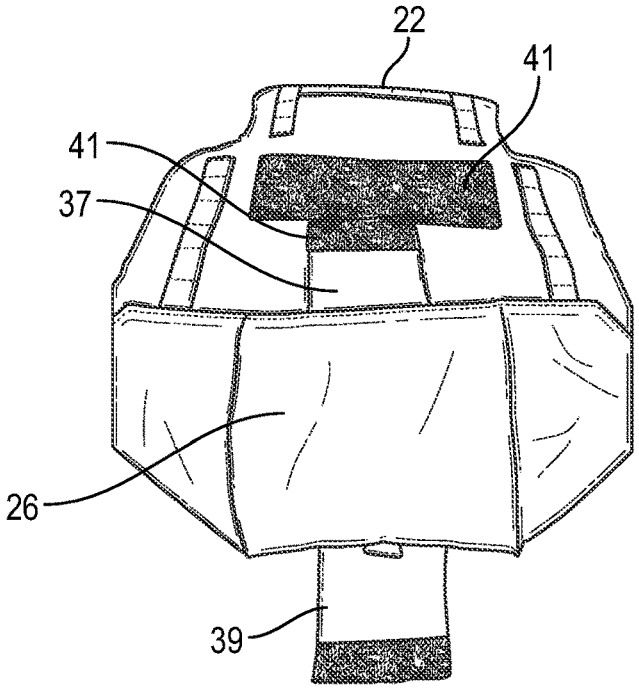
FIG. 10A shows a strike face view of the carrier of the ballistic shield of FIG. 9 with a pocket portion thereof in an untucked state.
Figure 10B:
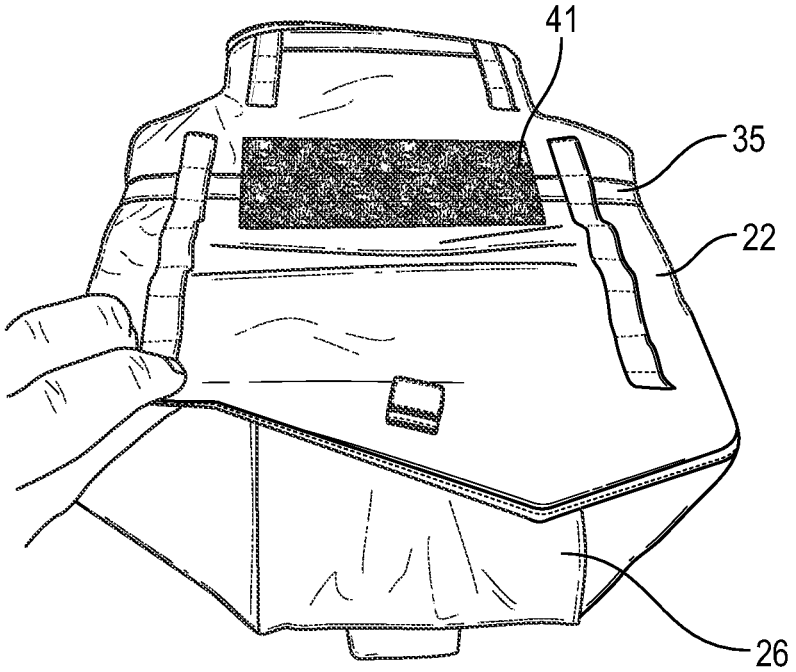
FIG. 10B shows a strike face view of the carrier of the ballistic shield of FIG. 9 with a pocket portion thereof in a tucked state.
Figure 10C:
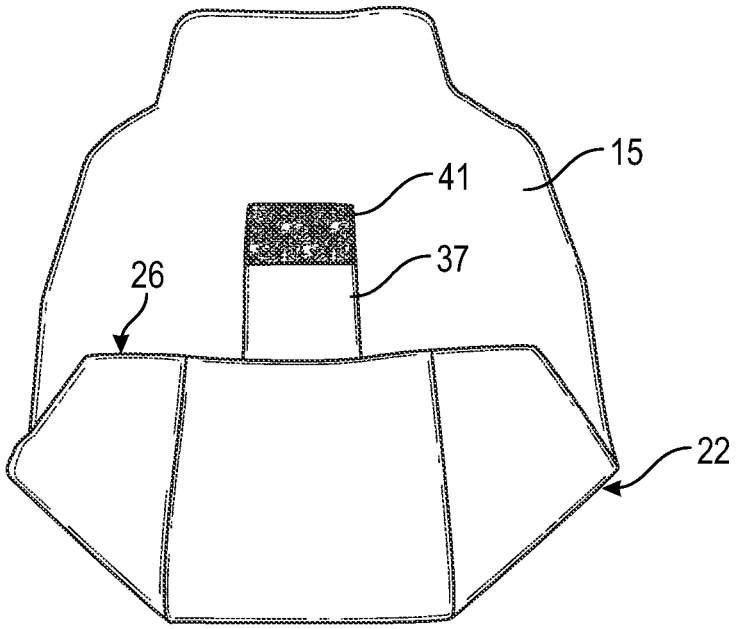
FIG. 10C shows a strike face view of the carrier of the ballistic shield of FIG. 9 with a pocket portion thereof, and the bottom of the ballistic panel received in the pocket. In this view, the strike face fabric side of the carrier is removed.
Figure 10D:
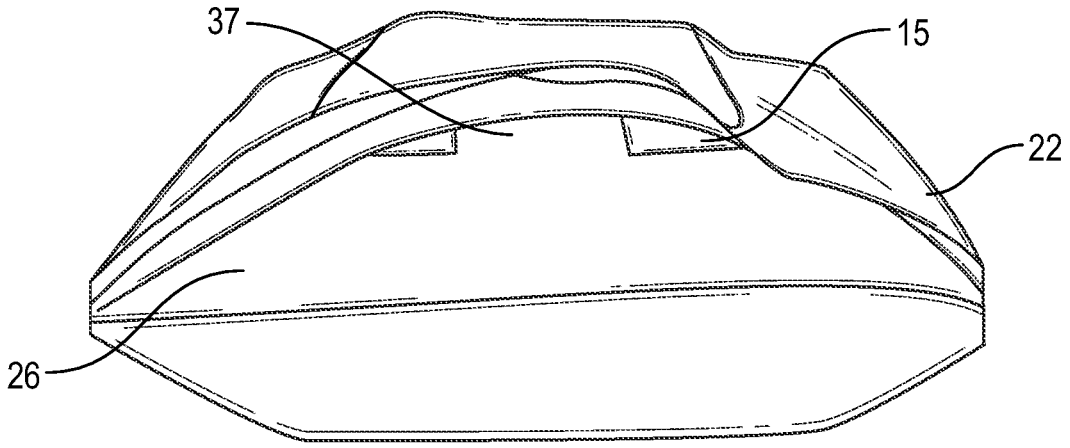
FIG. 10D shows another view of the carrier of the ballistic shield, with the strike face fabric of the carrier lifted so that the pocket portion extension of the rear face fabric of the carrier may be seen in its tucked state.

As further disclosed below, a ballistic shield 17 (FIGS. 9 and 11) according to the present invention includes fabric-encapsulated imbricated ceramic tiles 18 (referred to as an armor panel, FIGS. 4 and 5) that may be based on the personal armor system disclosed in the '651 patent, backed by layers of ballistic fabric 20 (FIGS. 6, 7 and 8), the combination of which makes up a ballistic panel 15 (FIGS. 10C and 10D). The ballistic panel 15 can be sealed in a water-tight fabric cover.

Figure 5:
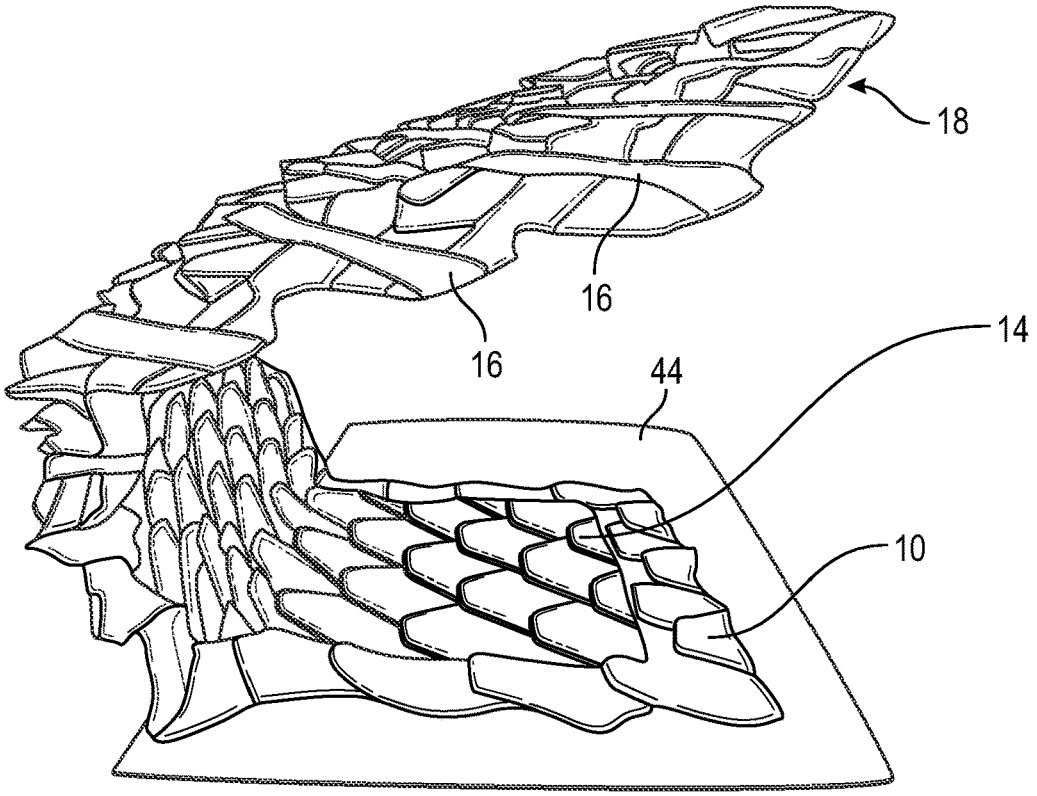
FIG. 5 shows the armor panel rolled into a U-shape.

The system disclosed in the '651 patent includes ceramic tiles held in an imbricated pattern by vacuum-formed ballistic fabric encapsulation in which the inside surfaces of the fabric are coated with an adhesive. While the personal armor system shown in the '651 patent is flexible, it is still too stiff to roll up into an adequately tight radius of curvature for compact storage. In this context, adequately tight radius of curvature means that the armor panel 18 can, for example, be folded so as to form a compact U-shape as seen in FIG. 5 with a radius of curvature in the range of 5-7 inches.

A ballistic shield 17 (including the armor panel 18, which along with backing ballistic fabric make up a ballistic panel 15 residing inside a carrier 22) according to the present invention includes features that allow it to be rolled up so that it may, for example, be stored on the passenger seat or the floor of the passenger seat of a typical squad car.

Furthermore, a ballistic shield 17 according to the present invention has an armor panel 18 with features that enhance its ballistic reliability, and longevity. For example, the armor panel 18 is devised so that after repeated rolling up and deployment, the positions of the tiles in their imbricated pattern is not altered, which would otherwise form ballistic weak spots.

FIGS. 1-8 demonstrate the steps in and the components for the fabrication of a ballistic panel 15 according to the present invention.

Figure 1:
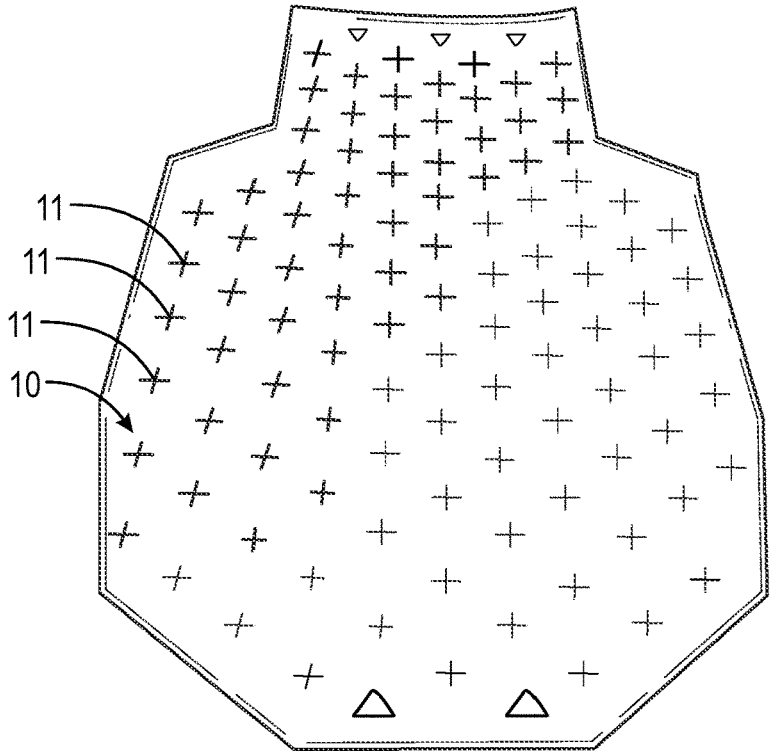
FIG. 1 shows a ballistic aramid fabric with marked tile placement positions, which on the reverse side from that viewed, adhesively receives the ceramic tiles of the armor panel as part of a ballistic shield according to the present invention.

Referring to FIG. 1, a ballistic aramid fabric 10 is cut into the desired shape. The shape in FIG. 1, is an example configuration which provides efficient body-like silhouette coverage, thus limiting potentially unnecessary coverage and associated weight. One side of the ballistic aramid fabric sheet 10 (the side opposite that viewed in FIG. 1) is laminated with adhesive, which in turn is covered with wax paper.

Figure 2:
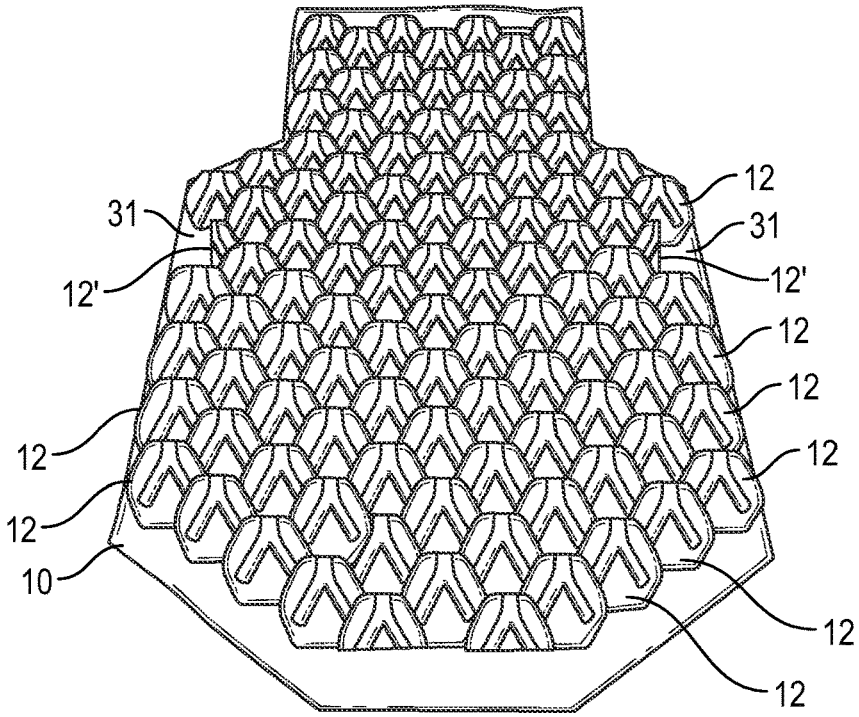
FIG. 2 shows the rear-face side of the ballistic tiles arranged in an imbricated manner on the reverse side of the ballistic aramid fabric shown in FIG. 1.

The ballistic aramid fabric 10, as viewed in FIG. 1, is marked with markings 11. Each marking 11 indicates the correct location for an individual carbon-fiber-wrapped boron carbide tile 12 to be assembled into an imbricated pattern, as seen in FIG. 2.

To arrange the carbon-fiber-wrapped boron carbide tiles 12 in the imbricated pattern, the ballistic aramid fabric 10 as seen in FIG. 1 is flipped over, set on a light table to illuminate the fabric, and the wax paper is removed. The position markings are thus made visible, allowing the carbon-fiber-wrapped boron carbide tiles 12 to be correctly positioned on the adhesive coated surface of the ballistic aramid fabric 10. FIG. 2 shows the array of carbon-fiber-wrapped boron carbide tiles 12 arranged in an imbricated pattern on the side of the ballistic aramid fabric 10 that has adhesive thereon. The faces of the carbon-fiber-wrapped boron carbide tiles 12 visible in FIG. 2 are the rear faces. The rear face is that which faces the user. The strike face faces away from the user and is closer to the first point of impact of the bullet.

Figure 3:
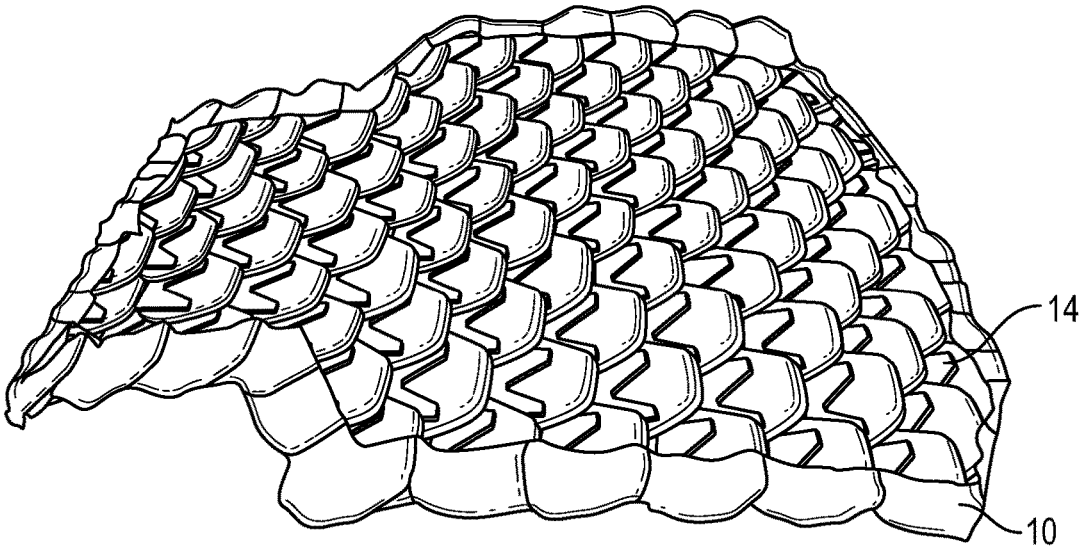
FIG. 3 shows the reverse side of the arrangement seen in FIG. 2 after a prepreg carbon fiber fabric is conformed to and set on the strike-face side of ballistic aramid fabric under the tiles seen in FIG. 2.

In the next step, a sheet of carbon fiber prepreg fabric (a weave of carbon fiber with un-set epoxy between the fibrous fabric weave) is placed on the strike face side of the aramid fabric sheet 10, in contact with the face that does not have adhesive thereon. Glass fiber prepreg fabric can be a substitute for the carbon fiber prepreg fabric. The assembly is then placed in a vacuum bag, vacuum is drawn on the bag interior, which causes the sheet of aramid fabric 10 and the carbon fiber prepreg fabric to compress into and follow the contours of the imbricated pattern of carbon fiber-wrapped ceramic tiles. While still under vacuum, the assembly is placed in an autoclave and heated to set the epoxy in the sheet of carbon fiber prepeg fabric and adhesively integrate the carbon fiber fabric with the aramid fabric sheet 10. Optionally, additional autoclave pressure can be applied (75 to 100 psi, for example). FIG. 3 shows the encapsulated ceramic tile assembly after the carbon fiber prepreg fabric 14 is set. In this embodiment, the carbon fiber sheet 14 does not extend to the edges of the ballistic aramid fabric 10, leaving the aramid sheet 10 to have a margin around the carbon fiber sheet 14. The margin may be, for example, one inch wide.

It was discovered that, without the thermoset carbon fiber sheet 14, and with only the adhesive on the ballistic aramid fabric 10, when the panel was repeatedly rolled and then deployed, neighboring carbon-fiber-wrapped boron carbide tiles 12 would slide under one another in the roll direction during rolling, pulling away from the adhesive-coated aramid fabric. With repetition, the carbon-fiber-wrapped boron carbide tiles 12 were allowed to lose their precise placement in the imbricated pattern, opening up locations of ballistic vulnerability.

The application of (bag interior) vacuum and (bag exterior) autoclave pressure (75 to 100 psi, for example) forces the aramid fabric and carbon fiber prepreg to accommodate to the shape of the imbricated pattern of wrapped ceramic tiles. The heat-treatment then sets the carbon fiber prepreg, which then permanently adopts the shape of the imbricated pattern (i.e., is molded over the carbon-fiber-wrapped boron carbide tiles 12), providing each carbon-fiber-wrapped boron carbide tile 12 a pocket to be locked into. The set carbon fiber sheet 14 is selected to permit the rolling of the ballistic panel, but does not permit the tiles to lose their mutual alignment when the ballistic shield 17 is repeatedly rolled and then deployed (i.e., to its flat state). As an alternative, the carbon fiber sheet can be formed into the imbricated pattern shape by bagging it with a machined aluminum or steel mold, machined with the imbricated pattern, and autoclaving the assembly. Using peel-ply between the sheets of carbon fiber, many sheets can be simultaneously molded in this way.

An additional merit of the use of the molded carbon fiber sheet is that it adds stiffness to the panel which causes it to somewhat resist rolling, and also spring straight/flat when deployed.

After the setting of the carbon fiber prepreg, an open lattice of adhesive-laminated aramid fabric strips 16 are laid onto the rear face of the assembly (FIG. 4), which is the face opposite to the face on which the set carbon fiber sheet 14 resides, and the assembly is placed in a vacuum bag. By pulling and holding vacuum on the bag interior, the aramid fabric lattice 16 is made to tightly adhesively adhere to the rear face of the carbon-fiber-wrapped boron carbide tiles 12. Alternatively, a lattice could be defined by cutting openings or slits into a single sheet of ballistic aramid fabric (with a CNC cutting table, for example) to yield the same/similar functionality of a lattice of fabric strips.

Aramid is a strong tear-resistant fabric which works well for the rear face lattice and the strike face adhesive-coated encapsulant to the imbricated pattern of carbon fiber wrapped ceramic tiles. Other fabrics which have these characteristics, such as ballistic nylon, can serve the same purpose.

Referring to FIG. 5, when the armor panel 18, having the adhesive-laminated aramid fabric strips 16, is rolled so that the rear face is on the outside, the lattice formed with the adhesive-laminated aramid fabric strips 16 allows the tiles to lift away from one-another, on one side of each tile, along a row of tiles oriented in the roll direction. Use of a continuous sheet of aramid (or other) fabric on the rear faces of the carbon-fiber-wrapped boron carbide tiles 12 would hinder the rolling of the imbricated pattern of the carbon-fiber-wrapped boron carbide tiles 12 as this tile lifting would be restricted.

The use of the lattice of adhesive-laminated aramid fabric strips 16 on a surface opposite of the strike face (i.e., the strike face having the set carbon fiber sheet 14 thereon) allows the armor panel 18 to roll so that the rear face is exteriorly and the strike face is interiorly when the armor panel 18 in the ballistic shield 17 is in its rolled state. That is, the armor panel 18 is configured so that in the rolled-up state, the armor panel 18 has the strike face in the interior, and the rear face on the outer radial surface thereof.

Furthermore, while the lattice of adhesive-laminated aramid fabric strips 16 allows the assembly to be rolled with less constriction, that lattice, assists the set carbon fiber sheet 14 in returning the wrapped ceramic tiles in the armor panel 18 to their correct relative alignment in the imbricated pattern.

Figure 6:
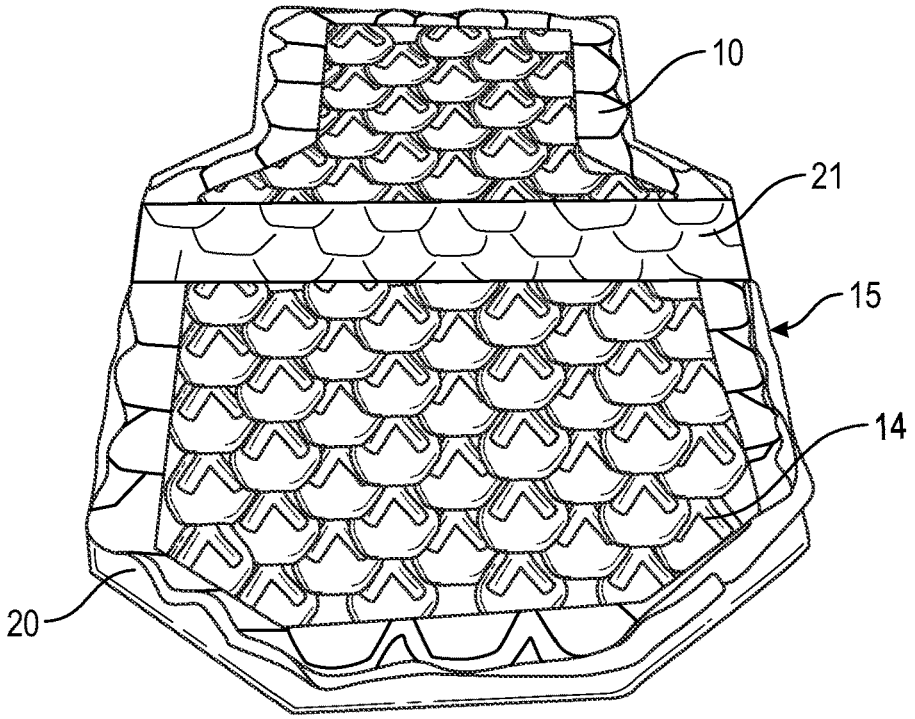
FIG. 6 shows the strike face side of the armor panel, as is shown in FIG. 3 with a ballistic aramid fabric strip across the width thereof for attachment to ballistic fabric backing sheets for fabricating a ballistic panel.

A ballistic panel 15 (FIGS. 10C and 10D) typically includes layers of ballistic fabric 20 positioned on the rear face side of the armor panel, as shown in FIG. 6. The layers of ballistic fabric 20 may be sheets of ultra-high molecular weight polyethylene or aramid. It is important that this stack of sheets 20 remain aligned with the armor panel 18 when the ballistic shield 17 is deployed. Mis-alignment in which the bullet interacts with only the armor panel 18, or only the ballistic fabric backing layer 20 will be regions of ballistic weakness.

A ballistic shield 17 according to the present invention may further include a carrier (discussed below) in which the ballistic panel 15 is received. If the ballistic fabric backing sheets 20 are a detached component of the armor panel 18, the alignment of the ballistic fabric backing sheets 20 and the armor panel 18 may be lost when the ballistic fabric backing sheets 20 and the armor panel 18 are jostled inside the carrier 22. Perimeter sewing together (sewing along all or along substantially all the edges) of the armor panel 18 and the ballistic fabric backing sheets 20 significantly restricts the ability of the armor panel 18 and consequently the ballistic panel 15 to roll up into its compact storage configuration (FIG. 11) because during roll-up, the tension developed on the outer radial surface and the compression developed on the inner radial surface will resist rolling.

As shown in FIG. 6, an aramid fabric strip 21 is adhesively attached to the strike face of the armor panel 18 and the rear face of the layers of ballistic fabric backing sheets 20, at an off-center location, for example, 2/3 the distance from the lowest edge of the armor panel 18. The aramid fabric strip extends from one side edge of the armor panel 18 on its strike face, wrapping around the other side edge of the panel 18, and returning on its wear face to form a complete loop. The ballistic fabric backing sheets 20 which are placed at the rear face of the armor panel 18, are affixed to the armor panel 18 only in the area of the aramid fabric strip 21. When the armor panel 18 is rolled, above (toward the top edge of the panel) and below (toward the bottom edge of the panel) the aramid fabric strip 21, the ballistic fabric backing sheets 20 can slide relative to the armor panel 18, which keeps the ballistic fabric backing sheets 20 and the armor panel 18 from opposing the rolling of armor panel 18 into a rolled state.

Figure 7:
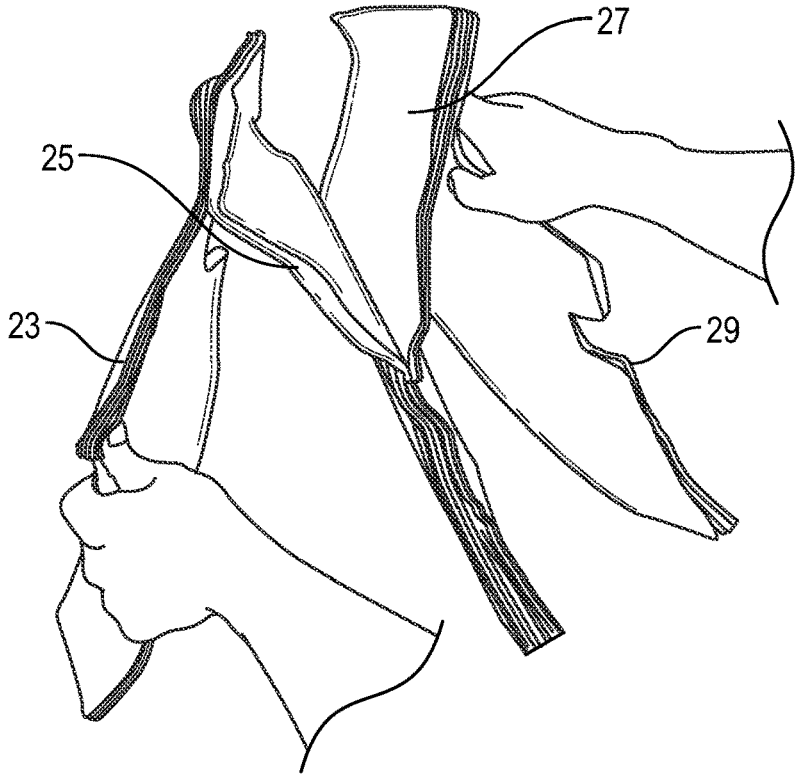
FIG. 7 shows strategically-sewn sub-packs of ballistic fabric used in the ballistic panel in an expanded state.

It has been further discovered that perimeter sewing together (along most or all of the edges) the ballistic fabric backing sheets 20 to maintain their alignment will similarly restrict rolling. Referring to FIG. 7, to overcome this additional problem, the ballistic fabric backing sheets 20 were sewn together into four sub-pack groups. These sub-packs were then tack-stitched together so that sub-packs 23 and 25, as well as sub packs 27 and 29, were tack stitched together near the top edges thereof only, while the sub-packs 25 and 27 were tack stitched together slightly above the centerline of the panel only. This configuration keeps the alignment of the sub-packs when the ballistic shield 17 is deployed, while allowing mutual sliding of the sub-packs during rolling and the un-rolling so that any fabric bunching tendency is attenuated. This pattern was chosen rather than tack stitching through all the sub-packs at the same location based on knowledge of the ballistic performance of ballistic fabrics held together by stitches. The important mechanism of (bullet) defeat is the frictional forces between interwoven fibers extending away from the location of ballistic interaction. As the bullet pushes into the fabric, the fabric extends toward the rear face, its displacement resisted by fibers distant from the bullet which pull against the friction of their neighbors. It is well known that when a bullet interacts with sheets of fabric close to a through-stitch (a stitch holding the entire stack of ballistic fabric sheets together), ballistic performance is degraded since the through stitch impedes the frictional fiber pull-out mechanism. Thus, the offset stitching of sub-packs described herein avoids through-stitches, while still accomplishing the purpose of avoiding fabric bunching and recovering fabric pack alignment when the shield is deployed.

Figure 8:
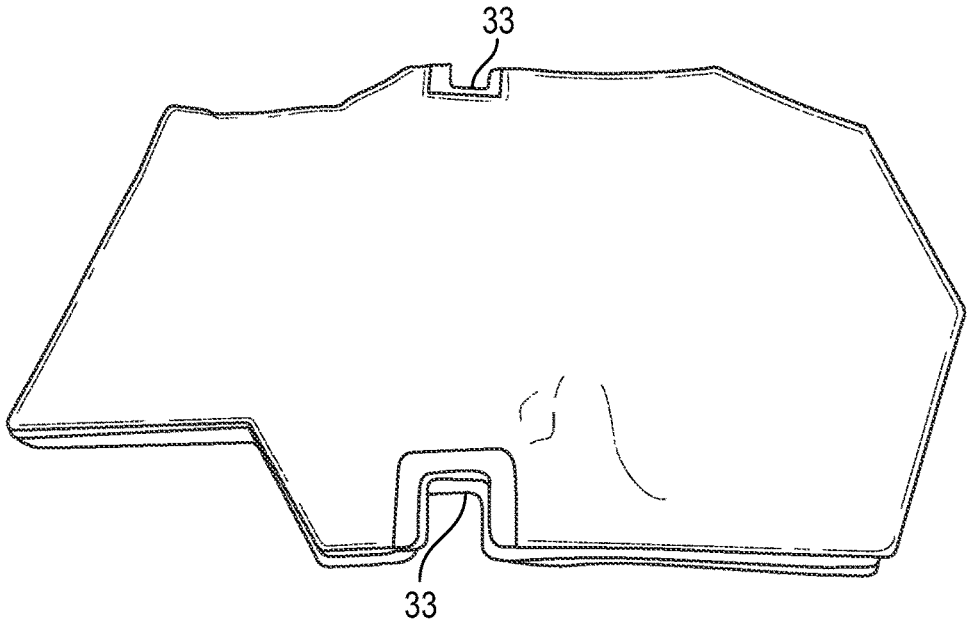
FIG. 8 shows the sub-packs of ballistic fabric in a collapsed state.

As shown in FIG. 2, at recessed regions marked 31, vertically-cut half tiles 12' are located along the vertical rows of full tiles 12. The ballistic fabric backing sheets 20 have notches 33 (FIG. 8) in alignment with the half tile 12' as seen in FIG. 8.

Optionally, a loose nylon cover may be ultrasonically welded around the ballistic panel 15 to provide waterproofing (not shown).

In a ballistic shield 17 according to the present invention, the carrier 22 and the ballistic panel 15 inside of the carrier move as one.

Referring to FIG. 9, when the ballistic panel 15 is placed inside of the carrier 22, a belt 35, which may be riveted or otherwise attached to the exterior of the carrier 22, is positioned so that when riveted tight, the belt 35 clamps into the notches 33 and toward the side edges of the half-tiles 12' in the armor panel 18. The belt 35 is positioned to be aligned with and extend over the adhesive-coated aramid strip 21 that holds the armor panel 18 and the backing sheets 20 together, whereby the ballistic panel 15 and the carrier 22 are held tightly to one another in the region of the belt 35. The carrier 22 further includes handles 30, which are sewn into the fabric of the carrier 22 closest to the rear face of the armor panel 18. Attachment points and handle orientations are designed to impose negligible interference with the roll-up and the deployment of the ballistic shield 17.

Figure 12A:
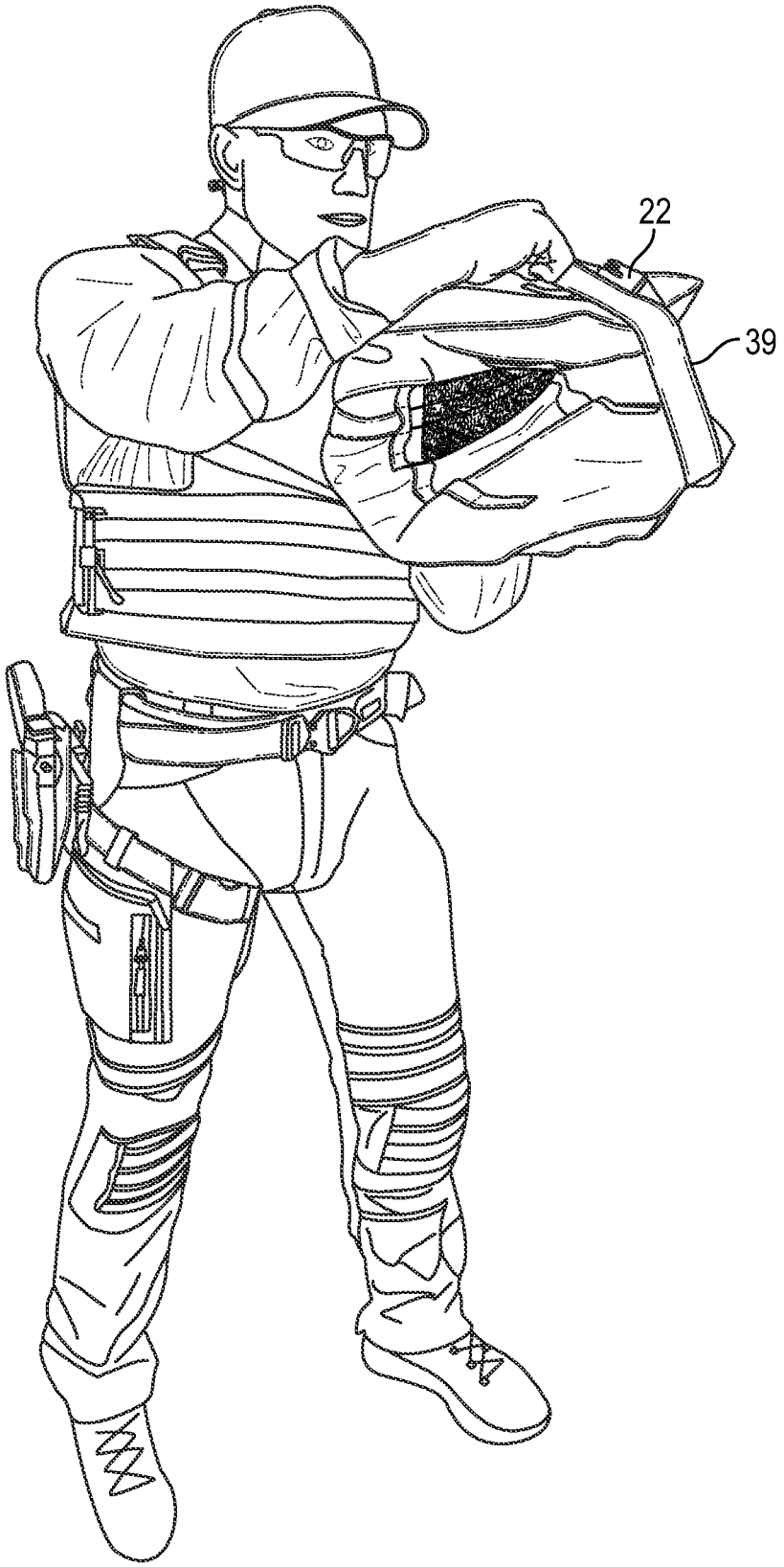
FIG. 12A shows the first step in deploying the ballistic shield.

The carrier 22 which holds the ballistic panel 15 must allow the expansion of the interior space thereof to accommodate the ballistic panel 15 in its rolled-up form, yet contract to maintain the ballistic panel 15 tight to upper edges when the ballistic shield 17 is deployed. It is not desirable to have the ballistic panel 15 sink below the carrier upper edges, since that is where the officer's face is, and where the officer may be peeking with one eye from the edge of the narrowed upper portion of the shield (FIG. 12D). Ideally, ballistic protection for the officer's face should be provided as close to the upper edges of the carrier as feasible. That is, carrier fabric at the bottom having a horizontal strip without the ballistic panel can be tolerated while assuring that the ballistic panel is tightly positioned at the top of the carrier in the deployed state.

In addition to the belt 35, to further keep the ballistic panel 15 from gravity-settling toward the base of the carrier 22 when the deployed ballistic shield 17 is held vertically (FIG. 12C), a tight fit between the ballistic panel 15 and the upper interior edge of the carrier 22 is desirable, as previously described. However, when rolling up the ballistic shield 17, a tight fit would resist the rolling action. Thus, as shown in FIG. 10A, a base pocket 26 is sewn into the carrier 22, attached to the rear face carrier fabric, which tucks into the carrier interior as seen in FIG. 10C. Connected to the top of the pocket 26 is an elastic tab 37 (FIG. 10A). A first pad 41 of a hook and loop fastener is sewn to the top edge of the tab 37. Once the ballistic panel 15 is inserted into the carrier 22 with its lower end received in the pocket 26 (FIGS. 10B and 10C), the first pad 41 of the hook and loop fastener is coupled to the second pad of the hook loop fastener (not shown) sewn into the interior of the strike face side of the carrier 22 such that the elastic tab 37 is modestly stretched, which allows the elastic tab 37 to provide a lifting action to the base of the pocket, which assists the belt 35 in maintaining the top section of the ballistic panel 15 pressed against the upper interior edge of the carrier 22. When the carrier 22 is rolled, the dimensions of the carrier 22 dilate at the base thereof as needed. The dilation occurs by the stretching of the elastic tab 37, and the sliding of the fabric at the base of the pocket 26 along the base of the ballistic panel 15 (i.e. the fabric fed from elastic tab 37 side of the carrier 22, and added to the length of fabric on the opposite side of the carrier 22).

Figure 11:
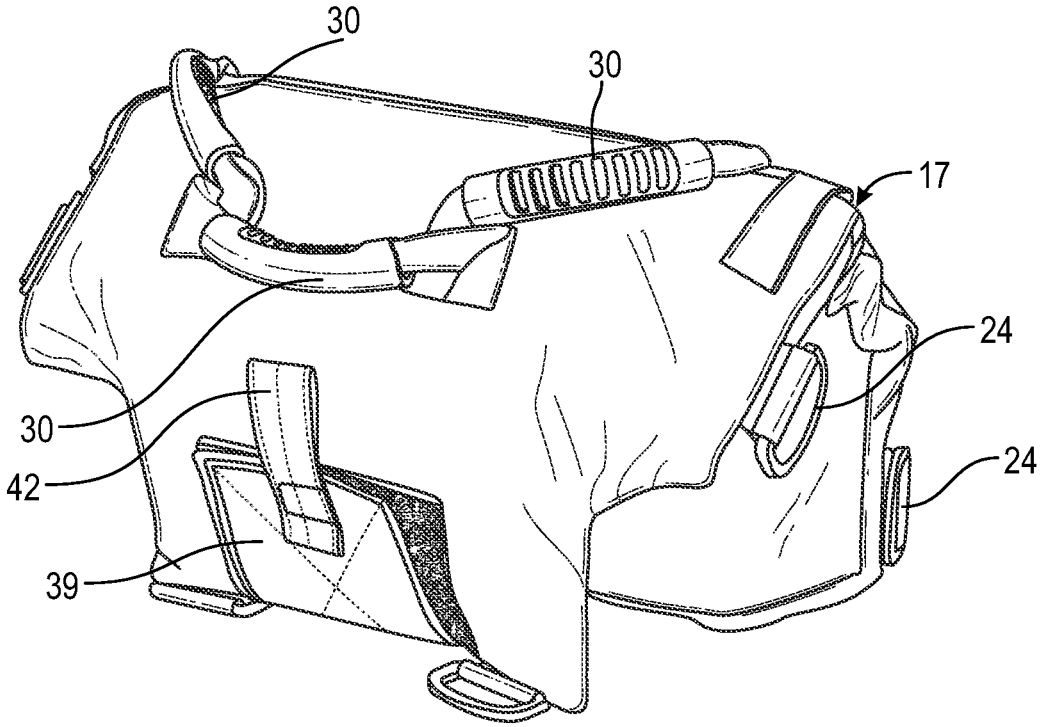
FIG. 11 shows the ballistic shield according to the present invention in a U-shaped rolled up compact state.

An example of a rolled version of the ballistic shield 17 is shown in FIG. 11.

The carrier 22 may further include a closure pad 39. The closure pad 39 may be sewn to the carrier 22 along a bottom edge thereof. The closure pad 39 may be releasably coupled to an exterior surface of the carrier 22 with, for example, a hook and loop releasable fastener arrangement. That is, one part of a hook and loop fastener 41 may be attached to the closure pad 39 and the other part of the hook and loop fastener 41 may be attached to a surface of the carrier at a top portion of the rear face thereof. As seen in FIG. 11, when the closure tab 39 is releasably attached to the carrier 22 by the hook and loop fastener arrangement, the ballistic shield 17 is maintained in a rolled state. In this state, the rear faces of the imbricated pattern of tiles 12 (facing the same direction as the rear face of the ballistic shield 17) are closest to the exterior surface of the rolled ballistic shield, while the strike faces of the imbricated pattern of tiles 12 (facing the same direction as the strike face of the ballistic shield 17) are closest to the interior surface of the rolled ballistic shield.

Referring to FIG. 9, D-rings 24 may be fixed to the rear side of the carrier 22 having the handles 30; i.e., the rear face of the ballistic shield.

Figure 12B:
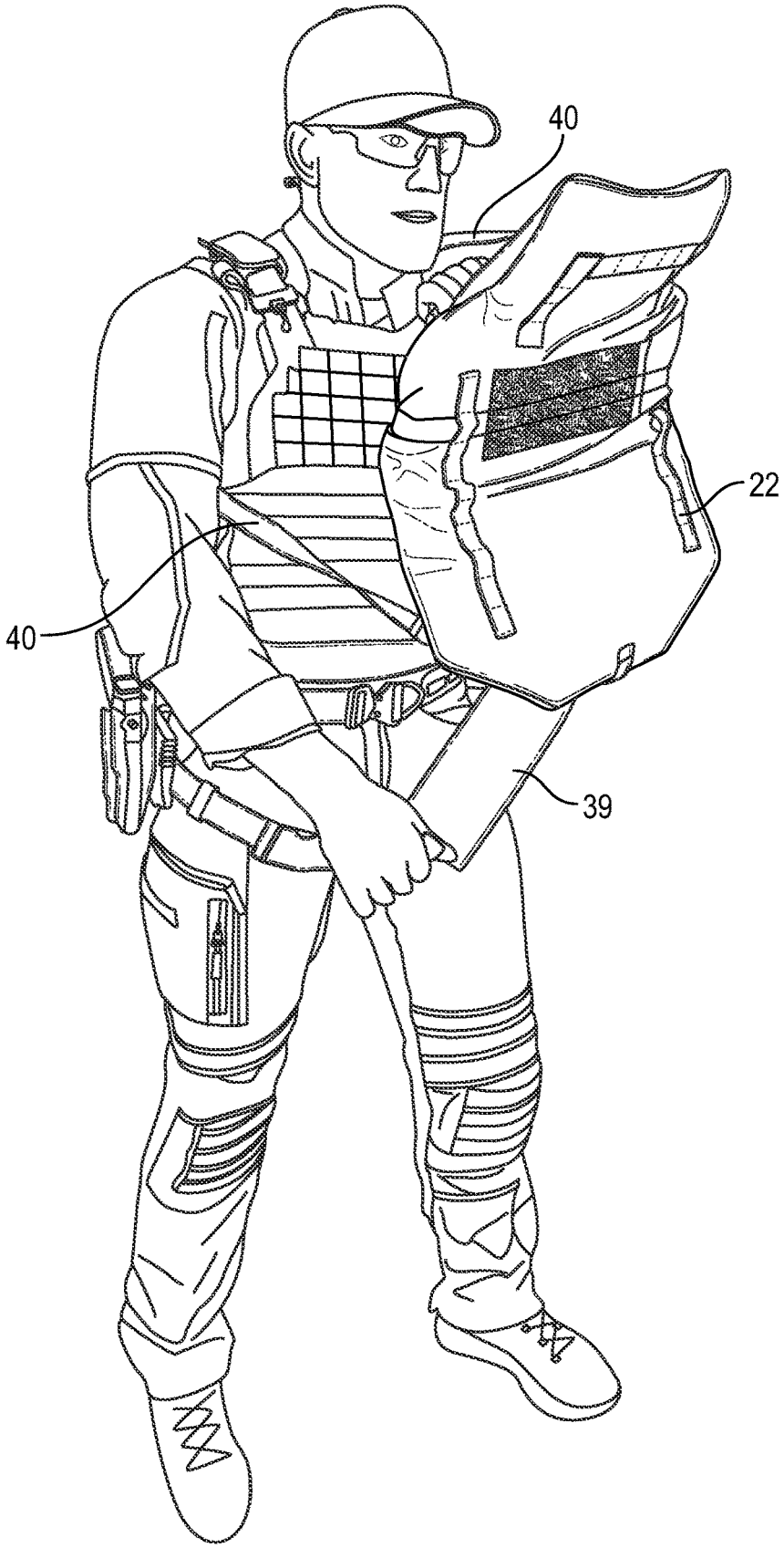
FIG. 12B shows the second step in deploying the ballistic shield.

Referring to FIG. 12B, a rifle sling 40 may be attached to diagonally opposite D-rings 24. With the rifle sling 40, the rolled ballistic shield 17 may be carried over the user's shoulder, leaving the hands free until it is needed.

The ballistic shield 17, when deployed (unrolled) needs to be flat to maximize coverage.

As shown in FIG. 12A, to deploy the ballistic shield 17, the user may hold the carrier 22 such that the closure tab 39 is farther from the ground than the handles 30 with the interior surface of the rolled ballistic shield 17 facing away from the user. In this state, the user may hold on to the centrally located handle 30, or pass his/her arm through one of the other two handles 30, while holding on to the other one of the other two handles 30. Thereafter, while holding the ballistic shield 17, by pulling the loop 42 that is attached to the closure tab 39 (FIG. 11), the closure tab 39 is disengaged from the carrier 22. In this state, the ballistic shield 17 may not be yet fully flat (FIG. 12B). The user may further flatten the ballistic shield 17 by pushing the ballistic shield 17 away from the user with his/her forearm while the sling 40 is over the shoulder and pressing against the back of the user, acts to hold the upper and lower ends of the shield stationary, as seen in FIG. 12B.

Figure 12C:
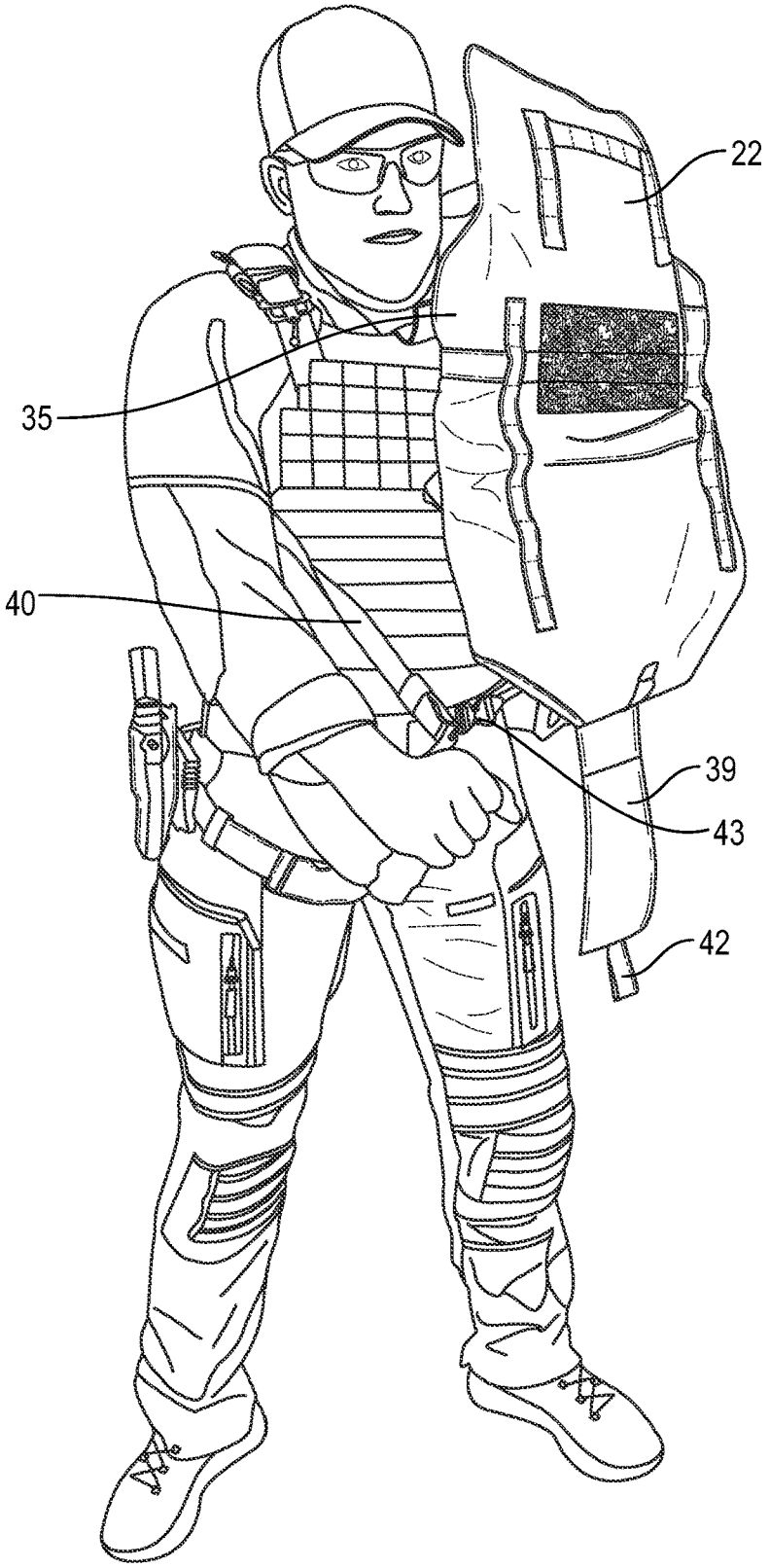
FIG. 12C shows the (optional) third step in deploying the ballistic shield.
Figure 12D:
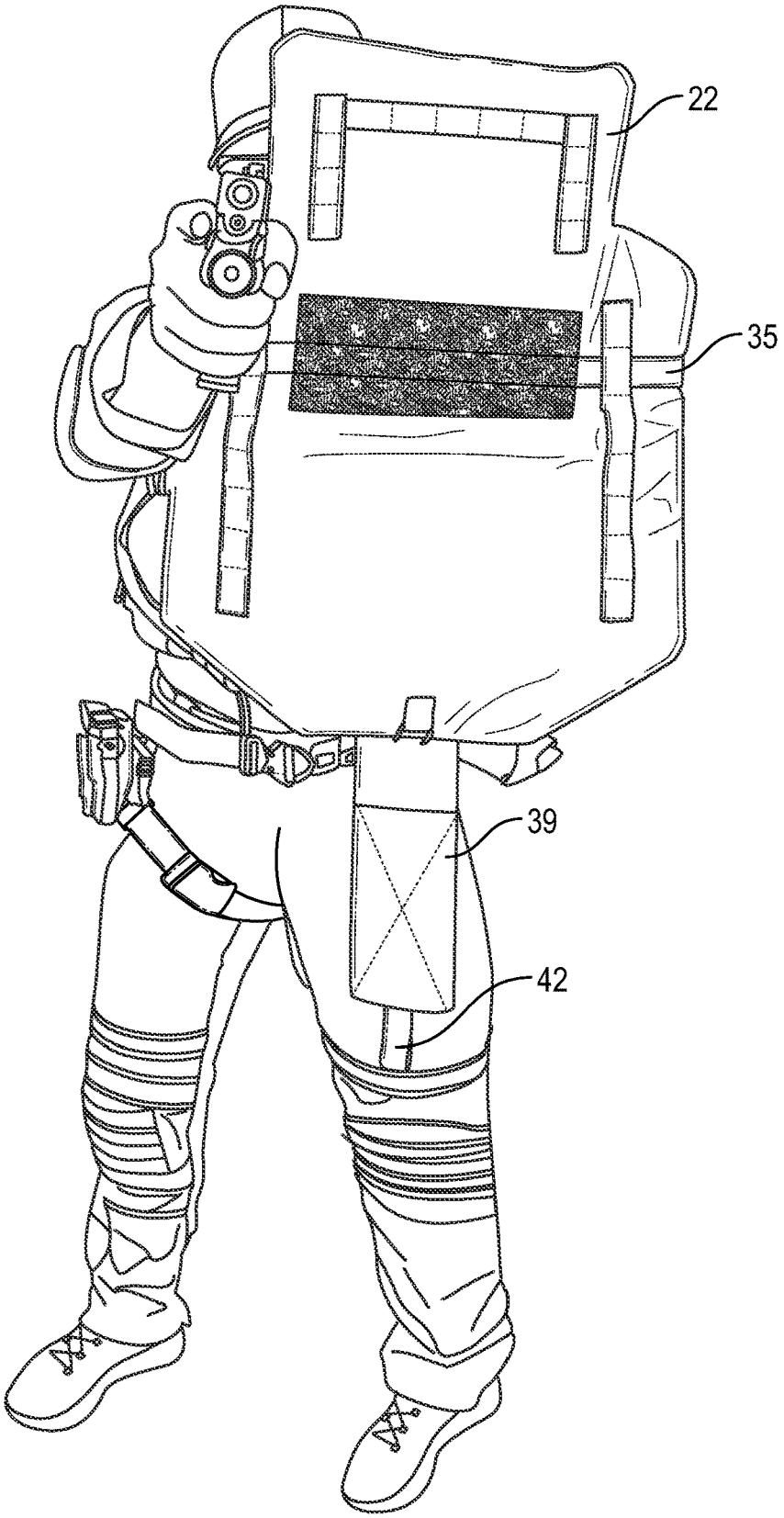
FIG. 12D shows a front (strike face) view of the ballistic shield in a deployed state.

As shown in FIG. 12C, a desired extent of slack in the rifle sling 40 may be removed by pulling the sling 40 through a buckle 43, which further straightens the ballistic shield 17 by pulling on the upper and lower regions of the ballistic shield 17 at the D-ring connections, relative to a fixed position of the forearm holding handle(s) 30.

Figure 13:
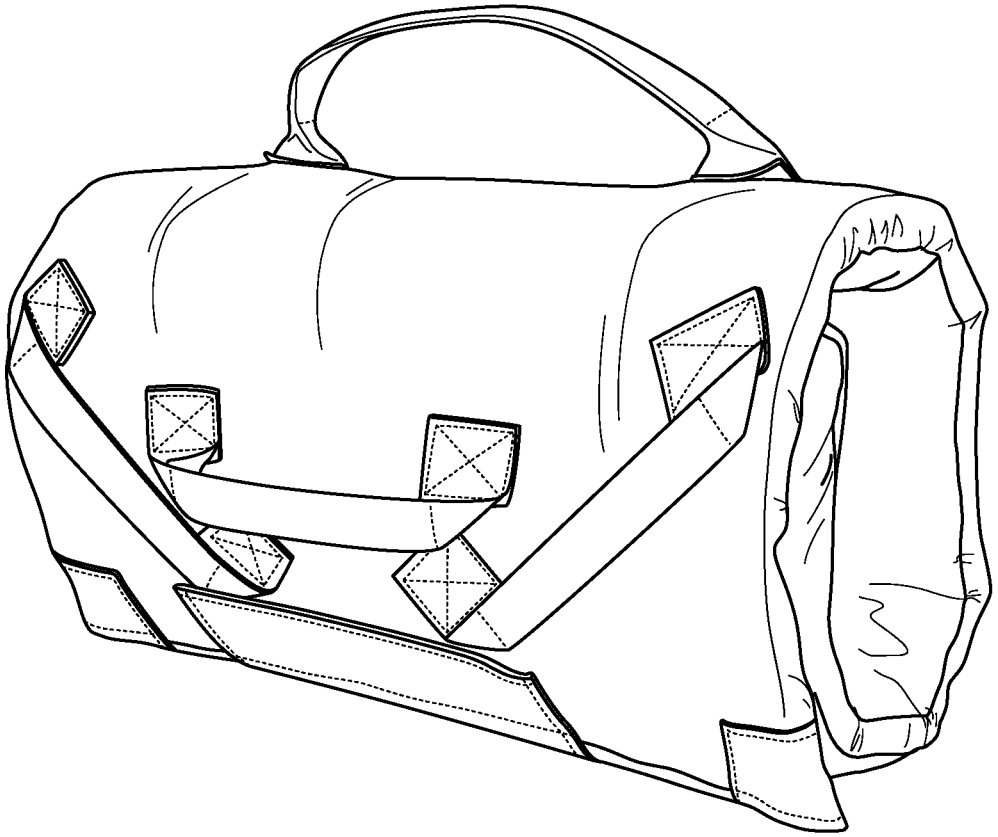
FIG. 13 depicts a ballistic shield 18 inches wide, and 36 inches long in the rolled state.

Other ballistic shield dimensions may be manufactured using the previously described principles/procedures. FIG. 13 shows a ballistic shield of 18 inches wide, and 36 inches long in the rolled state. Rather than forming a U-shape, the side-view rolled-up appearance of this ballistic shield is that of a spiral. Other dimensions are equally feasible, with the overall shield weight being the limiting consideration. The dimensions of the example shown in FIG. 13 would provide rifle-threat protection for an officer from the top of his/her head to somewhat below the beltline when standing upright. The example armor panel shown in FIG. 13 may weigh approximately 15 pounds when Verco boron carbide tiles available from Verco Materials, LLC (https://www.verco-materialsllc.com) are used to form the assembly. With the additional ballistic fabric backing sheets and the carrier with necessary hardware (discussed below), the ballistic shield should weigh approximately 25 lbs, which is a suitable weight since shields weighing above approximately 30 lbs are a challenge for some individuals to hold with one hand.

In the rolled-up state, the example shown in FIG. 13, a ballistic shield according to the present invention will fit in a place within reach of the officer in a squad car, as previously described.

A deployed ballistic shield of dimensions 18 inches wide and 36 inches long could be rolled on top of a prone injured individual, functioning as a protective ballistic blanket.

A common maneuver of law enforcement operators is to set a shield with its bottom edge on the ground and crouch down behind the shield, whereby the shield provides head-to-toe protection.

In another application a police sniper can use a rectangular shield with its long edge on the ground, and the opposite edge having a notch to set the barrel of his/her rifle. The deployed shield will provide ballistic protection to the sniper in a prone position.

The backing ballistic fabric sheets (located opposite the strike face fabric) may be sewn into independent sub-packs of fabric sheets. The sub-packs may be mutually attached using tack stitches at different locations attaching different sub-packs with elastic thread. In this form, the sub-packs may slide over one another during roll-up and deployment without forming bulges.

With the known ballistic shields, in addition to a handle, there is the option to add a stirrup for the elbow of the hand holding the handle. This two-point contact facilitates better control and manipulation of the shield. Using the CO2 inflation concept mentioned below, such a stirrup, and a short arm which offsets the stirrup away from the armor, could be inflated during deployment, but otherwise be in a collapsed form which would not interfere with the roll-up of the armor panel 19. Also, foam padding at the contact regions of the forearm with the rear face of the shield may be added to minimize injury from the blunt force of non-perforating bullet impact.

Standard ballistic shields often come with windows made of transparent ballistic material. Depending on the ballistic threat level, these can be made of thick polycarbonate, or laminations of glass and polycarbonate. For more severe rifle threats, the window can be made of sintered transparent ceramic spinel or ALON. Polished sheets of single-crystal sapphire have also been used. A window made with transparent ballistic material may also be incorporated into a ballistic shield according to the present invention, with the caveat that the window should not have dimensions in the vertical direction that interfere with rolling up the ballistic shield.

The tiles used in the fabrication of an armor panel according to the present invention may be wrapped with a ballistic containment fabric (e.g. first variation) or may be unwrapped (e.g. second variation), as disclosed, for example in the '651 patent. The ceramic used for the tiles should be of high hardness and low theoretical density (weight), examples are boron carbide, silicon carbide, or aluminum oxide.

The U.S. National Institute of Justice (NIJ) Certified Testing Protocol (CTP) specifies ballistic testing methodology and oversees certification of personal body armor against various specified threats (bullet types and velocities). Under its testing system, threats coming from handgun rounds are referred to as Levels IIA, II, or IIIA. Threats coming from long guns are separated into Level III and Level IV. The threat used in present Level III (NIJ CTP 0101.06) test is the M80 ball round, which is a steel-jacketed lead core round weighing 9.6 grams with a muzzle velocity (its greatest velocity, which is as it exits the muzzle of the rifle) of 847 m/s, yielding a kinetic energy of 3.44 kJ. A NIJ test intended to replace the Level III test (NIJ CTP 0101.07) will additionally test the M855 round, which is a copper-jacketed steel bullet weighing 4.0 grams with a muzzle velocity of 950 m/s, yielding a kinetic energy of 1.80 kJ, and the M43 MSC (mild steel core) round, which is a copper-jacketed steel bullet weighing 7.81 grams with a muzzle velocity of 725 m/s, yielding a kinetic energy 2.05 kJ. Defeating these threats is of the greatest interest to U.S. law enforcement, whereas the greater Level IV threat (M2AP) is a sniper round seen in military theaters.

The aforementioned threats are evaluated for body armor, where the armor is placed against a clay backing and shot, where the use of clay emulates armor against the human body. There is a separate NIJ test for ballistic shields, NIJ Standard 0108.01, in which the shield is held in a frame, and has nothing behind it. Rollable ballistic shields constructed according to the present invention with an armor panel 18 as described herein and backed by 95 sheets of high molecular weight polyethylene 20 were shot at a certified testing lab (NTS Wichita, who released reports from those tests). Three ballistic shields were tested, one against five rounds of the M80 ball round at muzzle velocity, one against five rounds of the M855 at muzzle velocity, and one against five rounds of the M43 MSC at muzzle velocity. The rounds impacted the shields at distributed locations. Testing was performed in accordance with the NIJ Standard 0108.01. The rollable shields so constructed defeated all the projectiles. An additional (fourth) ballistic shield was rolled and unrolled 300 times as a fatigue test, and then ballistically tested with five rounds of the M80 ball round at muzzle velocity. This shield also defeated all five of the shots against it. The results of the test are provided in Tables 1-4.

TABLE 1

NATIONAL TECHNICAL SYSTEMS
BALLISTIC RESISTANCE TEST

| | | | |
|---|---|---|---|
| Date Received | Mar. 23, 2023 | Record No: | VRM23003-2 |
| Via: | Hand Carry | Test Date: | Mar. 23, 2023 |
| Returned Via: | Hand Carry | Customer: | Verco Materials LLC |
| Test Conditions | | Range 3 | |
| Temperature: | 68.6° F. | Muzzle to Screen 1: | 5.15 ft. |
| Humidity: | 44% | Screen 1-2: | 5.00 ft. |
| Test Standard: | Modified NIJ Standard 0108.01. September 1985 | Screen 2-Target: | 39.85 ft. |
| | | Midpoint to Target: | 42.35 ft. |
| Classification: | III | Witness: | 2024-T3 Aluminum |
| Shots Required: | 5 | Target to Witness: | 0.50 ft. |
| Conditioning | Ambient | | |

Sample Tested Description

| | |
|---|---|
| Manufacturer: | Verco Materials LLC |
| Sample No.: | Shield |
| Serial No.: | 320 |
| Lot No.: | N/A |
| Weight (lbs.) | 15.552 |

Test/Ammunition Description

| Shot No. | Shot Location | Degree Obliquity | Caliber | Bullet Weight |
|---|---|---|---|---|
| 1 | Bottom Left | 0° | 7.62 × 51 mm | 150/FMJ (M80) |
| 2 | Middle Left | 0° | | |
| 3 | Middle Right | 0° | | |
| 4 | Top Center | 0° | | |
| 5 | Bottom Right | 0° | | |

| Chronograph | | Test Results |
|---|---|---|
| Time sx-5 | Velocity ft/s | Penetration No Penetration |
| 179.6 | 2784 | No Penetration |
| 180.4 | 2772 | No Penetration |

TABLE 1-continued

NATIONAL TECHNICAL SYSTEMS
BALLISTIC RESISTANCE TEST

| | | |
|---|---|---|
| 180.6 | 2769 | No Penetration |
| 181.3 | 2758 | No Penetration |
| 180.0 | 2778 | No Penetration |

This test was performed in accordance with the specification requirements and the results properly reflect the ballistic performance of the listed sample.

National Technical Systems. Inc.
7447 W. 33rd St. N.
Wichita, KS 67205 U.S.A
Phone: 316-832-1600

Notes:

Sample hanging on fixture using clamps at the top of sample
Sample marked by customer
Ammunition Description:

7.62 mm 150 FMJ (M80)
Velocity: 2750 +/− 50 ft/s
Shot Locations/Spacing:

Minimum Requirement: 2.0" (50 mm) shot-to-edge and shot-to-shot.
Project Manager: Montgomery
Technician(s): Wilson

TABLE 2

NATIONAL TECHNICAL SYSTEMS
BALLISTIC RESISTANCE TEST

| | | | |
|---|---|---|---|
| Date Received | Mar. 2, 2023 | Record No: | VRM23002-1 |
| Via: | Hand Carry | Test Date: | Mar. 2, 2023 |
| Returned Via: | Hand Carry | Customer: | Verco Materials LLC |
| Test Conditions | | Range 4 | |
| Temperature: | 67.7° F. | Muzzle to Screen1: | 6.56 ft. |
| Humidity: | 41% | Screen 1-2: | 5.00 ft. |
| Test Standard: | Modified* NIJ Standard 0108.01, September 1985 | Screen 2-Target: | 39.37 ft. |
| | | Midpoint to Target: | 41.87 ft. |
| Classification: | Special Threat | Target to Witness: | 0.50 ft. |
| Shots Required: | 5 | Witness: | 2024-T3 Aluminum |
| Conditioning | Dry | | |

Sample Tested Description

| | |
|---|---|
| Manufacturer: | Verco Materials LLC |
| Sample No.: | Shield |
| Serial No.: | N/A |
| Lot No.: | N/A |
| Weight (lbs.) | 17.266 |

Test/Ammunition Description

| Shot No. | Shot Location | Degree Obliquity | Caliber | Bullet Weight (gr.)/Type |
|---|---|---|---|---|
| 1 | 1 | 0° | 5.56 × 45 mm | 62/M855 |
| 2 | 2 | | | |
| 3 | 3 | | | |
| 4 | 4 | | | |
| 5 | 5 | | | |

| Chronograph | | Test Results |
|---|---|---|
| Time | Velocity ft/s | Penetration No Penetration |
| 160.0 | 3125 | No Penetration |
| 158.8 | 3149 | No Penetration |
| 158.5 | 3155 | No Penetration |
| 160.2 | 3121 | No Penetration |
| 159.0 | 3145 | No Penetration |

TABLE 2-continued

NATIONAL TECHNICAL SYSTEMS
BALLISTIC RESISTANCE TEST

| | |
|---|---|
| This test was performed in accordance with specification requirements and the results properly reflect the ballistic performance of the listed sample . | National Technical Systems. Inc.<br>7447 W. 33rd St. N.<br>Wichita, KS 67205 U.S.A<br>Phone: 316-832-1600<br>Fax: 316-832-1602<br>Email: ust;@nts.com |

Notes:

Sample hanging on fixture using clamps at the top of sample
Sample marked by customer
Modified* threat not listed in NIJ0108.01
Sample Description:

Customer Proprietary
Project Manager: Montgomery
Technician(s): Wilson, Randolph

TABLE 3

NATIONAL TECHNICAL SYSTEMS
BALLISTIC RESISTANCE TEST

| | | | |
|---|---|---|---|
| Date Received | Mar. 23, 2023 | Record No: | VRM23003-1 |
| Via: | Hand Carry | Test Date: | Mar. 23, 2023 |
| Returned Via: | Hand Carry | Customer: | Verco Materials LLC |
| Test Conditions | | Range 3 | |
| Temperature: | 68.8° F. | Muzzle to Screen1: | 5.15 ft. |
| Humidity: | 44% | Screen 1-2: | 5.00 ft. |
| Test Standard: | Modified* NIJ Standard 0108.01, September 1985 | Screen 2-Target: | 39.85 ft. |
| | | Midpoint to Target: | 42.35 ft. |
| Classification: | Special Threat | Witness: | 2024-T3 Aluminum |
| Shots Required: | 5 | Target to Witness: | 0.50 ft. |
| Conditioning | Ambient | | |

Sample Tested Description

| | |
|---|---|
| Manufacturer: | Verco Materials LLC |
| Sample No.: | Shield |
| Serial No.: | 321 |
| Lot No.: | N/A |
| Weight (lbs.) | 15.034 |

Test/Ammunition Description

| Shot No. | Shot Location | Degree Obliquity | Caliber | Bullet Weight (gr.)/Type |
|---|---|---|---|---|
| 1 | Bottom Left | 0° | 7.62 × 51 mm | 123/MSC (M43) |
| 2 | Middle Left | 0° | | |
| 3 | Middle Right | 0° | | |
| 4 | Top Center | 0° | | |
| 5 | Bottom Right | 0° | | |

| Chronograph | | Test Results |
|---|---|---|
| Time | Velocity ft/s | Penetration No Penetration |
| 210.7 | 2373 | No Penetration |
| 212.2 | 2356 | No Penetration |
| 212.4 | 2354 | No Penetration |
| 209.6 | 2385 | No Penetration |
| 212.8 | 2350 | No Penetration |

| | |
|---|---|
| This test was performed in accordance with specification requirements and the results properly reflect the ballistic performance of the listed sample. | National Technical Systems. Inc.<br>7447 W. 33rd St. N.<br>Wichita, KS 67205 U.S.A<br>Phone: 316-832-1600 |

Notes:

Sample hanging on fixture using clamps at the top of sample
Sample marked by customer TABLE 3-continued

NATIONAL TECHNICAL SYSTEMS
BALLISTIC RESISTANCE TEST

Modified* Threat not listed in NIJ 0108.01.
Ammunition Description:

Russian 7.62 × 39 mm 123 gr. MSC (M43)
Velocity: 2380 +/− 30 ft/s
Shot Locations/Spacing:

Minimum Requirement: 2.0" (50 mm) shot-to-edge and shot-to-shot.
Project Manager: Montgomery
Technician(s): Nguyen

TABLE 4

NATIONAL TECHNICAL SYSTEMS
BALLISTIC RESISTANCE TEST

| | | | |
|---|---|---|---|
| Date Received: | May 10, 2023 | Record No.: | VRM23005-1 |
| Via: | UPS | Test Date: | May 11, 2023 |
| Returned Via: | UPS | Customer: | Verco Materials, LLC |
| Test Conditions | | Range 3 | |
| Temperature: | 69.1 ° F. | Muzzle to Screen 1: | 5.15 ft. |
| Humidity: | 54 % | Screen 1-2 | 5.00 ft. |
| Test Standard: | Modified abbreviated NIJ Standard 0108.01, September 1985 | Screen 2-Target. | 39.85 ft. |
| | | Midpoint to Target: | 42.35 ft. |
| Classification: | III | Witness: | 2024-T3 Aluminum |
| Shots Required: | 5 | Target to Witness: | 0.50 ft. |
| Conditioning: | Ambient | | |

| Sample Tested Description | | Test/Ammunition Description: Shot No. | Shot Location | Degree Obliquity | Caliber | Bullet Weight (gr.)/ Type | Chronograph Time | Chronograph Velocity ft/s | Test Results Penetration No Penetration |
|---|---|---|---|---|---|---|---|---|---|
| Manufacturer: | Verco Materials LLC | 1 | Bottom Left | 0° | 7.62 × 51 mm | 150/FMJ (M80) | 181.8 | 2750 | No Penetration |
| Sample No.: | Shield | | | | | | | | |
| Serial No.: | RT58 | 2 | Middle Left | 0° | | | 182.9 | 2734 | No Penetration |
| Lot No.: | N/A | | | | | | | | |
| Weight (lbs.): | 14.800 | 3 | Middle Right | 0° | | | 182.5 | 2740 | No Penetration |
| | | 4 | Top Center | 0° | | | 181.1 | 2761 | No Penetration |
| | | 5 | Bottom Right | 0° | | | 182.0 | 2747 | No Penetration |

The test was performed in accordance with the specification requirements and the results properly reflect the ballistic performance of the listed sample.

National Technical Systems, Inc.
7447 W. 33rd St. N.
Wichita, KS 67205 U.S.A.
Phone: 316-832-1600

Notes:

Sample hanging on fixture using clamps at the top of the sample.
Sample marked by customer.
Ammunition Description:

7.62 mm 150 FMJ (M80)
Velocity: 2750 +/− 50 ft/s
Shot Locations/Spacing:

Minimum Requirement: 2.0" (50 mm) shot-to-edge and shot-to-shot.
Project Manager: Montgomery
Technician(s): Randolph, Nguyen For those knowledgeable in ballistic armor materials, it is known that consolidated ballistic fabric such as high molecular weight polyethylene can improve ballistic performance. This would be true when the ballistic fabric is behind an armor panel consisting of an imbricated pattern of carbon fiber-wrapped boron carbide tiles. Consolidation refers to autoclaving together sheets wherein the thermoplastics residing between the fiber weave fuse together to form an inflexible plate. In this form; however, consolidated backing fabric to the armor panel would yield a ballistic shield which would not roll. However, a steel mold may be machined which has a corrugated pattern, with the grooves of the corrugation running in the narrow (horizontal) dimension of the shield. Autoclaving the ballistic fabric against that mold will yield a corrugated consolidated backing fabric. In that form the consolidated backing fabric will roll. When incorporated with an armor panel to form a ballistic shield, that shield, with enhanced ballistic stopping power over an otherwise equivalent weight ballistic shield with unconsolidated backing fabric, will roll.

Figure 14:
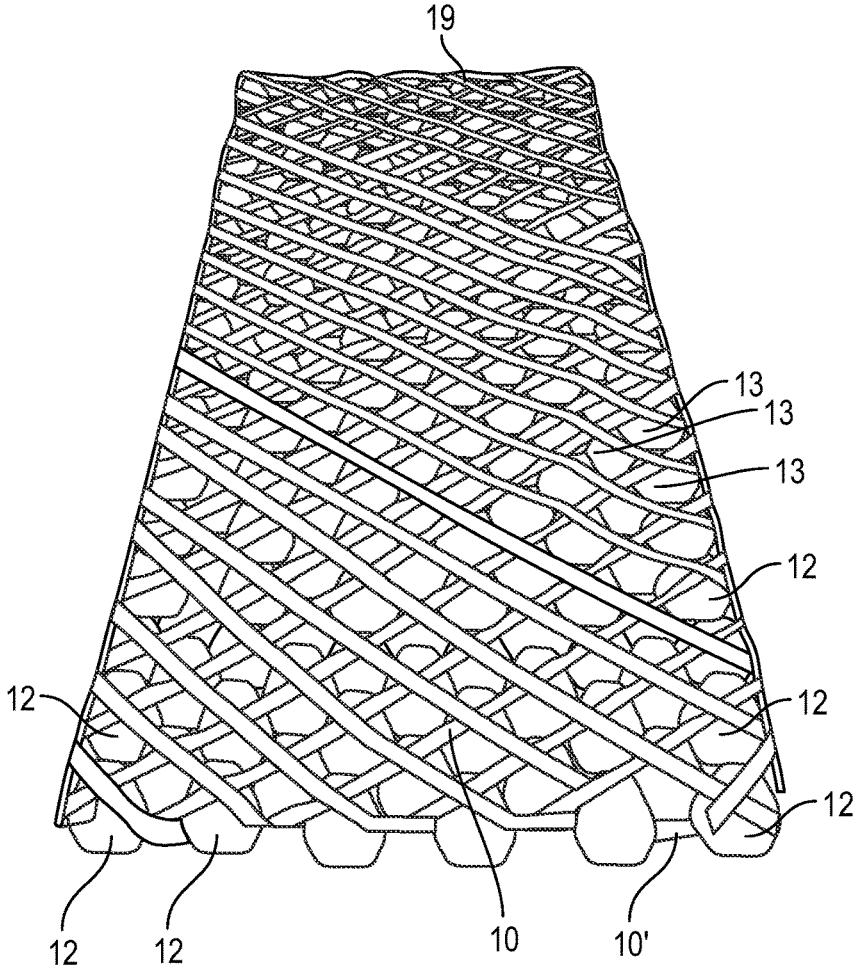
FIG. 14 shows a lattice of ballistic aramid fiber strips on the strike-face side of the imbricated tile assembly of the armor panel according to another variation of the present invention in a deployed (unrolled) state.

Referring to FIG. 14, which shows the front (strike) face of an armor panel 19 according to another variation, similar methods as previously described may be employed in order to enable the personal armor system shown in the '651 patent to be rollable. The rear face of the imbricated carbon fiber-wrapped tiles 12 are adhesively attached to the ballistic aramid fabric 10' and another ballistic aramid fabric in the form of strips 10 are adhesively attached to the strike face of the carbon fiber-wrapped tiles 12.

As seen in FIG. 14, a plurality of openings 13 left by the aramid strips 10 in the ballistic aramid fabric at the front (strike) face lattice pattern partially exposes the ballistic tiles 12 in the imbricated pattern while partially covering the ballistic tiles 12 in the imbricated pattern to assist in maintaining the tiles 12 in their positions when unrolled (deployed state, FIG. 14).

As seen in FIG. 14, in the deployed state (for example, flat state), the wrapped tiles 12 remain overlapped in an imbricated pattern to provide protection against projectiles such as bullets.

Figure 15:
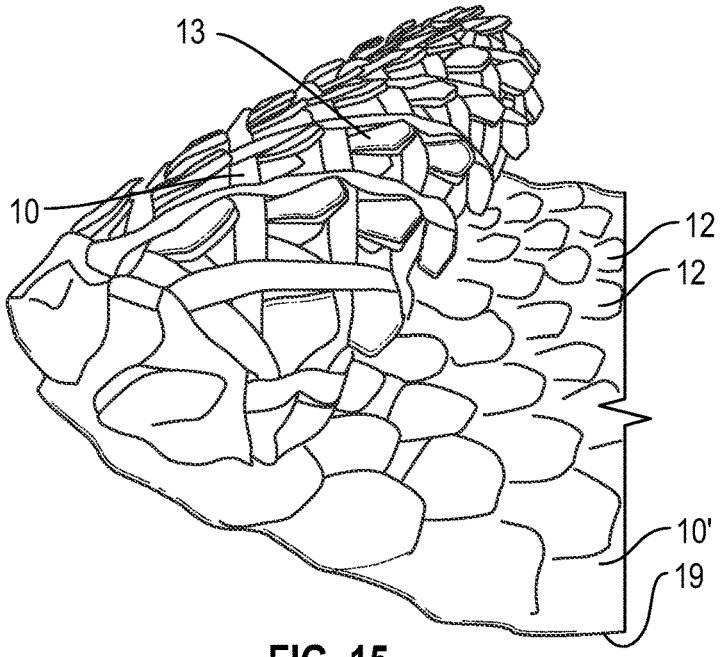
FIG. 15 shows the armor panel of FIG. 14 in a partially rolled up state with the strike face thereof being oriented toward the exterior of the rolled up shield.

Referring to FIG. 15, when the armor panel 19 is rolled, the cutouts 13 allow the ceramic tile rows to pivot relative to the underlying (i.e. overlapped) row of tiles 12, allowing the armor panel 19 to be rolled up into a tight radius of curvature.

In the example shown in FIGS. 14 and 15, the armor panel rolls such that the strike is exteriorly and the rear face is interiorly when the armor panel 19 is in its rolled state. That is, the armor panel 18 is configured so that in the rolled-up state, the armor panel 18 has the strike face in the interior, and the rear face on the outer radial surface thereof. To make a ballistic shield using this armor panel, ballistic fabric sheets would be affixed to the rear face of the armor panel and the resulting ballistic panel would be inserted into a carrier to make a ballistic shield.

A ballistic shield based on an armor panel 19 in FIGS. 14 and 15 would be useful to roll out on elongated seating areas of vehicles in which the strike face facing downward would be used as protection against fragments from explosives detonated from underneath the vehicle. Alternately, one end of such a shield can be hung from the top of a door. After the shield is gravity unrolled (deployed) it would provide protection from rifle threats coming in through the door.

The ballistic shield of FIGS. 14 and 15 can also be used as a ballistic blanket to roll over a potential explosive device.

An armor panel 19 according to the present invention may use stiffeners that stiffen at least the long (vertically-oriented) edges of the armor panel 19 once deployed so that the panel maintains its shape when its bottom edge is set down.

Each stiffener may be an elongated body (e.g. a rod) that can be removably integrated with a long edge of the assembly. For example, the assembly may have a channel along each long edge thereof to receive a stiffener rod. Each channel may be defined as an extension of a pack of ballistic fabric backing sheets located at the rear face of the armor panel 19, beyond the edges of the strike face thereof, to form vertically-oriented margins, each of which would be in the range of 1 to 4 inches wide, typically 2 inches wide.

The stiffener rod may be defined by a plurality of rod segments that snap into magnetic couplings at the ends thereof once aligned into a line when, for example, the armor panel 19 is deployed. The rod segments would be held in vertically-oriented fabric channels running along the long sides of the armor panel 19.

Alternately, lightweight metallic flat rod segments may be connected through spring loaded pivot points. The springs may be selected to resist rolling up the armor panel 19, and favor the straight configuration to enable the armor panel 19 to hold its shape when set on the ground. A locking mechanism shaped into the rods similar to those used in folding tables may be employed when the armor panel 19 is fully deployed.

The ballistic fabric backer sheets may be affixed to the armor panel 19 by tabs of ballistic fabric sheet (with adhesive on one side) extending from a margin of the strike face to the same margin of the wear face (facing the user of the armor panel 19) of the backing fabric stack. The assembly may in turn be sealed in a water-tight cover, which is either elastomeric, or has the necessary slack to facilitate roll-up and deployment.

An armor panel 19 according to the present invention may be equipped with a handle. For example, a plastic, hollow cylinder, covered in stiff fabric can be provided to run horizontally (from one long edge of the assembly to the other long edge of the assembly) at a location approximately one quarter of the vertical distance of the armor panel 19, relative to the top edge. The cylinder will serve as a handle for the armor panel 19, and the fabric holding the cylinder may be sewn or crimped into the aforementioned vertically-aligned margins. Being horizontally aligned, and near the top, the handle should impose negligible interference with the roll-up and the deployment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A rollable armor panel, comprising:

a first ballistic fabric;

a plurality of ballistic tiles arranged on and attached to one side of the first ballistic fabric; and a lattice arrangement comprising ballistic fabric attached to faces of the ballistic tiles and located opposite to the one side, the lattice having openings over the ballistic tiles, wherein the armor panel is flexible enough to permit rolling of the armor panel into a rolled state.

2. The rollable armor panel of claim 1, wherein the faces of the ballistic tiles are rear faces of the ballistic tiles.

3. The rollable armor panel of claim 1, wherein the faces of the ballistic tiles are strike faces of the ballistic tiles.

4. The rollable armor panel of claim 1, further comprising a second ballistic fabric integrated with another side of the first ballistic fabric opposite the one side of the first ballistic fabric.

5. The rollable armor panel of claim 4, wherein the tiles are arranged in an imbricated pattern, and wherein the first ballistic fabric is a ballistic aramid fabric, and the second ballistic fabric is a carbon fiber fabric thermoset into the imbricated pattern to provide a resilient return to a flat state from a rolled state and to hold the tiles in the imbricated pattern after repeated rolling and deployment.

6. A rollable ballistic shield, comprising, a carrier having an interior, and a ballistic panel residing in the interior of the carrier, the ballistic panel including the rollable armor panel of claim 1.

7. The rollable ballistic shield of claim 6, wherein the aramid fabric lattice is positioned over strike faces of the ballistic tiles.

8. The rollable ballistic shield of claim 6, further comprising a second ballistic fabric integrated with another side of the first ballistic fabric opposite the one side of the first ballistic fabric.

9. The rollable ballistic shield of claim 8, wherein the tiles are arranged in an imbricated pattern, and wherein the first ballistic fabric is a ballistic aramid fabric, and the second ballistic fabric is a carbon fiber fabric thermoset into the imbricated pattern to provide a resilient return to a flat state from a rolled state and to hold the tiles in the imbricated pattern after repeated rolling and deployment.

10. The rollable ballistic shield of claim 6, wherein the ballistic panel comprises ballistic fabric backing sheets on the rear side of the armor panel, attached to the armor panel only along a portion of a first side thereof and only along a portion of a second side thereof, the first side and the second side being opposite one another.

11. The rollable ballistic shield of claim 10, wherein the armor panel has a strike face, and further comprising a fabric strip loop that extends around the armor panel and the ballistic fabric backing sheets, wherein the fabric strip loop is adhesively attached to the strike face of the armor panel, and wherein a rear sheet of the ballistic fabric backing sheets is adhesively attached to the fabric strip loop, the fabric strip loop holding the armor panel and the backing sheets together along a limited area to maintain their mutual alignment, while permitting mutual sliding of backing sheets and armor panel at locations outside of these regions of attachment, facilitating rolling and unrolling, while maintaining layer alignment in the deployed state.

12. The rollable ballistic shield of claim 10, wherein the ballistic fabric backing sheets are in sub-packs, wherein a first sub-pack is attached directly along only a portion thereof to a portion of a second sub-pack only, the second sub-pack is attached at another portion thereof directly to only a portion of a third sub-pack, and the third sub-pack has another portion directly attached only to a portion of a fourth sub-pack, allowing for mutual sliding of the sub-packs at locations away from the points of attachment during rolling and unrolling, while maintaining sub-pack alignment in the deployed state without ballistially-degrading through-stitches binding all the sub-packs.

13. The rollable ballistic shield of claim 12, wherein the ballistic fabric backing sheets are sheets of ultra-high molecular weight polyethylene.

14. The rollable ballistic shield of claim 6, wherein the armor panel has recessed regions defined along opposite sides thereof, and wherein the carrier has a belt located on an exterior surface thereof to be accommodated in the recessed regions of the armor panel, whereby the carrier receives the ballistic panel tightly to prevent the ballistic panel from shifting position in the carrier when the shield is held.

15. The rollable ballistic shield of claim 6, wherein the carrier further comprises at least one handle.

16. The rollable ballistic shield of claim 6, wherein the carrier further comprises a plurality of D-rings, and a sling that is receivable in the D-rings.

17. The rollable ballistic shield of claim 6, wherein the carrier further comprises a closure pad that carries at least a portion of a releasable fastener that can be fastened to another portion of the fastener to maintain the rollable ballistic shield in a rolled state.

18. The rollable ballistic shield of claim 6, wherein the carrier further comprises at least one handle, a plurality of D-rings, and a sling that is receivable in the D-rings to permit the user to place the sling behind the user, grab the at least one handle, and flatten the shield by pushing the shield away.

19. The rollable ballistic shield of claim 6, wherein the ballistic panel further comprises a corrugated backing fabric which is consolidated and integrated with the armor panel.

20. The rollable ballistic shield of claim 6, wherein the carrier is expandable at its base for rolling and unrolling to keep the ballistic panel pressed to the top of the carrier.

21. The rollable ballistic shield according to claim 6, wherein the rollable ballistic shield can stop five rounds of M80 ball bullets, five rounds of M855 bullets, or five rounds of M43 MSC bullets.

22. The rollable ballistic shield according to claim 6, wherein the rollable ballistic shield can stop a round corresponding to the ballistic properties of a M855 round, wherein the tiles of the armor panel are imbricated, and the imbricated tiles of the armor panel present no gaps or seams in ballistic coverage.

23. The rollable armor panel of claim 1, wherein each tile of the ballistic tiles is wrapped with a ballistic fabric wrap.

24. The rollable armor panel of claim 1, wherein each tile of the ballistic tiles is unwrapped.

* * * * *